US007097266B2

(12) United States Patent
Tsuruoka et al.

(10) Patent No.: US 7,097,266 B2
(45) Date of Patent: Aug. 29, 2006

(54) IMAGE PRINTING APPARATUS AND CONTROL METHOD THEREFOR

(75) Inventors: Yuji Tsuruoka, Kanagawa (JP); Takashi Mouri, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 241 days.

(21) Appl. No.: 10/463,325

(22) Filed: Jun. 18, 2003

(65) Prior Publication Data

US 2003/0234827 A1 Dec. 25, 2003

(30) Foreign Application Priority Data

Jun. 19, 2002 (JP) ..... 2002-178827
May 14, 2003 (JP) ..... 2003-135796

(51) Int. Cl.
*B41J 29/38* (2006.01)

(52) U.S. Cl. ..... 347/14; 347/37; 400/279

(58) Field of Classification Search ..... 347/5, 347/14, 19, 37; 400/279, 280; 358/1.9
See application file for complete search history.

(56) References Cited

U.S. PATENT DOCUMENTS 4,723,129 A 2/1988 Endo et al. ..... 346/1.1
4,740,796 A 4/1988 Endo et al. ..... 346/1.1
5,117,374 A * 5/1992 Goetz ..... 702/150
5,600,350 A * 2/1997 Cobbs et al. ..... 347/19
5,788,385 A * 8/1998 Inoue et al. ..... 400/279
6,109,721 A * 8/2000 Kim ..... 347/19
6,354,691 B1 * 3/2002 Uchikata ..... 347/37
6,390,588 B1 * 5/2002 Ikeda ..... 347/19
6,457,797 B1 * 10/2002 Van Der Meijs et al. ..... 347/14

FOREIGN PATENT DOCUMENTS

GB 2 379 411 A * 12/2003
JP 2000-168151 6/2000

* cited by examiner

*Primary Examiner*—Lamson Nguyen
*Assistant Examiner*—Blaise Mouttet
(74) *Attorney, Agent, or Firm*—Fitzpatrick, Cella, Harper & Scinto

(57) ABSTRACT

An image printing apparatus is capable of printing an image at various resolutions, such as 300- and 360-dpi systems. To drive a printhead at a printing position corresponding to the resolution of printing data, information on whether to discharge ink separately in the forward and return passes of the printhead is stored in the storage area of a RAM in advance in correspondence with the main scanning position of the printhead. Data (0 or 1) stored in the RAM is read out by using, as a RAM address input, a count value output from a printhead position detection unit that represents the current position of the printhead. Only when the readout data is 1, a printing position pulse is generated to print an image at an arbitrary resolution. By setting ink discharge positions separately in the forward and return passes, an image can be printed at a high precision.

18 Claims, 17 Drawing Sheets

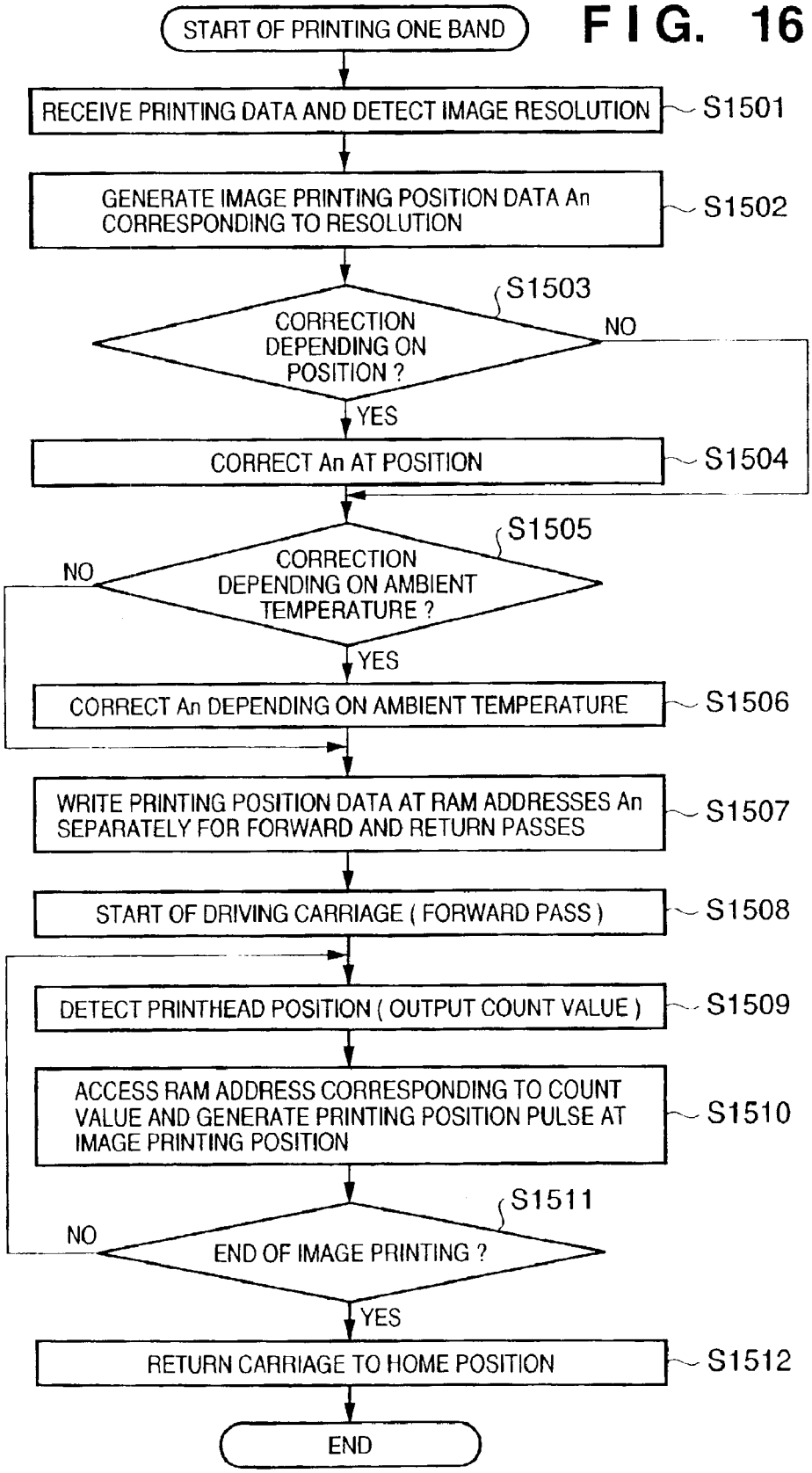
FIG. 16
START OF PRINTING ONE BAND
RECEIVE PRINTING DATA AND DETECT IMAGE RESOLUTION
S1501
GENERATE IMAGE PRINTING POSITION DATA An CORRESPONDING TO RESOLUTION
S1502
S1503
CORRECTION DEPENDING ON POSITION ?
NO
YES
CORRECT An AT POSITION
S1504
S1505
CORRECTION DEPENDING ON AMBIENT TEMPERATURE ?
NO
YES
CORRECT An DEPENDING ON AMBIENT TEMPERATURE
S1506
WRITE PRINTING POSITION DATA AT RAM ADDRESSES An SEPARATELY FOR FORWARD AND RETURN PASSES
S1507
START OF DRIVING CARRIAGE ( FORWARD PASS )
S1508
DETECT PRINTHEAD POSITION ( OUTPUT COUNT VALUE )
S1509
ACCESS RAM ADDRESS CORRESPONDING TO COUNT VALUE AND GENERATE PRINTING POSITION PULSE AT IMAGE PRINTING POSITION
S1510
S1511
END OF IMAGE PRINTING ?
NO
YES
RETURN CARRIAGE TO HOME POSITION
S1512
END

IMAGE PRINTING APPARATUS AND CONTROL METHOD THEREFOR

FIELD OF THE INVENTION

The present invention relates to an image printing apparatus which prints (draws) an image on a printing medium on the basis of image data input from a host computer or the like, a control method therefor, and a control program and, more particularly, to an image printing apparatus which prints an image by discharging a plurality of color inks from the nozzles of a plurality of printheads onto a printing medium such as a glass plate or film, a control method therefor, and a control program.

BACKGROUND OF THE INVENTION

FIG. 9 is a schematic view showing a conventional image printing apparatus using a color inkjet printing method.

In the image printing apparatus of FIG. 9, a motor 103 is driven in printing (drawing) an image on a printing medium 140 on a platen 106. A carriage 102 having printheads 120 to 123 is moved by a driving belt 109 to the position of a home position sensor 108. While the carriage 102 is moved along a forward pass indicated by an arrow X1 in the scanning direction, inks in black K, cyan C, magenta M, and yellow Y are discharged at a predetermined position from the printheads 120, 121, 122, and 123 in accordance with input image data, printing a predetermined image 133.

After the image 133 is printed by a predetermined length represented by 134 in FIG. 9, movement of the carriage 102 along the forward pass X1 of the scanning direction stops. While the carriage 102 is moved along a return pass indicated by an arrow X2 opposite to the forward pass in the scanning direction, the carriage 102 is returned to the start position (position of the home position sensor 108) for printing/scanning of the next image. While the carriage 102 is moved along the return pass, a feed roller 110 is rotated by a feed motor 107 to convey the printing medium 140 in a subscanning direction (direction indicated by an arrow Y) perpendicular to the main scanning direction by a length corresponding to the width 134 by which the image is printed by the printheads 120 to 123.

As described above, an image is printed on a printing medium while moving the carriage 102 in the main scanning direction, and the printing medium is conveyed in the subscanning direction by the width 134 of one band. This operation is repeated to complete printing of a color image.

Image printing operation in only the forward pass in the main scanning direction has been exemplified. Bi-directional image printing operation in both the forward and return passes in the main scanning direction is also possible. In this case, an image is printed in the forward pass, and the printing medium 140 is conveyed in the subscanning direction by a length corresponding to the width 134 of one band by which the image is printed by the printheads 120 to 123. After that, image printing is executed in the return pass in the main scanning direction, printing an image in both the forward and return passes. In FIG. 9, reference numerals 100 and 101 denote second feed rollers; and 111, a medium detection sensor.

The discharge timings of ink from the nozzles of the printheads 120 to 123 are generated by using an output signal from a linear encoder to be described later as a reference. The position of each printhead is detected by the linear encoder, and the linear encoder can detect the position at a precision corresponding to a necessary resolution (e.g., 1,200 dpi). In an image printing apparatus having such linear encoder, the image printing resolution and the precision of the image printing position are determined by a position detection signal output from the linear encoder.

The image printing apparatus realizes multicolor image printing by superposing black (K), cyan (C), magenta (M), and yellow (Y) inks discharged from the printheads 120, 121, 122, and 123 for image data (printing data) corresponding to the same pixel on the basis of position information from the linear encoder and the relative positions of the printheads 120, 121, 122, and 123. Hence, position information from a linear encoder 130 greatly influences the image quality.

At present, linear encoders used in such image printing apparatuses are generally a magnetic linear encoder, and an optical linear encoder 130 shown in FIG. 9. For example, the magnetic linear encoder is comprised of a metal linear scale plate formed by many magnetization portions in the scale unit, and a magnetic sensor which is attached onto the carriage 102 and detects magnetism at the magnetization portions of the linear scale plate.

As shown in FIG. 9, the optical linear encoder 130 is comprised of a band-like scale 131 which has a graduated grid and is formed by alternately printing a light-reflecting portion and non-reflecting portion on low-expansion-coefficient glass in the scale unit, and a sensor 132 which irradiates the scale 131 with light and receives light reflected by the scale 131. The sensor 132 is generally a device (light-projecting/receiving device) constituted by a light-projecting portion formed from an LED or laser source attached onto the carriage 102, and a light-receiving portion which is formed from a photodiode or phototransistor.

Either magnetic or optical linear encoder uses a home position as a reference position. Read pulse signals which are output from the sensor in the linear scale unit in response to movement of the carriage 102 are counted up/down by an encoder counter. The count value is read to obtain position information of the carriage 102 (e.g., Japanese Patent Laid-Open No. 2000-168151).

The image printing apparatus can print an image by a 300-dpi system, i.e., at resolutions of 1,200 dpi, 600 dpi, and 300 dpi for a linear encoder resolving power of 1,200 dpi, but cannot print an image at resolutions of 1,440 dpi and 720 dpi.

In general, the resolution of the image printing apparatus belongs to two systems: a 300-dpi system having resolutions of 300 dpi, 600 dpi, 1,200 dpi, . . . and a 360-dpi system having resolutions of 360 dpi, 720 dpi, 1,440 dpi, . . . . Most of the nozzle intervals of printheads used for image printing are formed in accordance with either system.

However, some recent image printing apparatuses print an image at an arbitrary resolution other than the 300- and 360-dpi systems, like an image printing apparatus which forms a liquid crystal filter. In the image printing apparatus which forms a liquid crystal filter, the landing precision of an ink dot discharged onto a printing medium must be as high as about several μm, and the cost of the image printing apparatus becomes high. Demands have therefore arisen for an image printing apparatus which can print an image at various resolutions such as the 300- and 360-dpi systems.

On the other hand, either type of encoder described above suffers a read position error depending on the component/assembly precision and scale patterning precision in manufacturing an encoder, and further a read position error caused by thermal expansion of the scale itself. These position errors are negligible in a general inkjet printer. In the image printing (drawing) apparatus for manufacturing a liquid crystal filter, the liquid crystal filter pattern is dense, and ink must be landed on a target position at a high precision. To realize this, the read position error of the encoder depending on the component/assembly precision and scale patterning precision in manufacturing an encoder must fall within the allowable range. A feed error depending on the pitching, yawing, and straightness of the carriage and printing medium moving means must be corrected to make the ink landing position error fall within the allowable range.

SUMMARY OF THE INVENTION

The present invention has been made to overcome the conventional drawbacks, and has as its object to provide an image printing apparatus capable of printing an image at various resolutions such as the 300- and 360-dpi systems.

To achieve the above object, an image printing apparatus according to an aspect of the present invention has the following arrangement. That is, there is provided an image printing apparatus which moves a carriage having a printhead in a main scanning direction different from a subscanning direction in which a printing medium is conveyed, and prints on the basis of input printing data, comprising storage means for storing printing position information representing a main scanning position at which printing is to be performed on the printing medium, printing position information generation means for generating the printing position information corresponding to a resolution of the printing data, position detection means for detecting a position of the printhead which moves in the main scanning direction, and generating a position signal, and printing position signal generation means for outputting a printing position signal for driving the printhead on the basis of the position signal and the printing position information read out from the storage means.

To achieve the above object, an image printing apparatus control method according to another aspect of the present invention has the following steps. That is, there is provided a method of controlling an image printing apparatus which moves a carriage having a printhead in a main scanning direction different from a convey direction of a printing medium, and prints on the basis of input printing data, comprising a generation step of generating printing position information corresponding to a resolution of the printing data, a storage step of storing the printing position information generated in the generation step at an address of storage means that corresponds to a printing position on the printing medium, a position detection step of detecting a position of the printhead during scanning with respect to the printing medium, and generating a position signal, and a printing position signal generation step of outputting a printing position signal for driving the printhead on the basis of the printing position information which is read out from the storage means in accordance with the position signal.

To achieve the above object, a control program of controlling an image printing apparatus according to still another aspect of the present invention has the following program codes. That is, there is provided a control program of controlling an image printing apparatus which moves a carriage having a printhead in a main scanning direction different from a subscanning direction in which a printing medium is conveyed, and prints on the basis of input printing data, comprising a program code for a generation step of generating printing position information corresponding to a resolution of the printing data, a program code for a storage step of storing the printing position information generated in the generation step at an address of storage means that corresponds to a printing position on the printing medium, a program code for a position detection step of detecting a position of the printhead during scanning with respect to the printing medium, and generating a position signal, and a program code for a printing position signal generation step of outputting a printing position signal for driving the printhead on the basis of the printing position information which is read out from the storage means in accordance with the position signal.

To achieve the above object, an image printing apparatus according to still another aspect of the present invention has the following arrangement. That is, there is provided an image printing apparatus which moves a carriage having a printhead in a main scanning direction different from a subscanning direction in which a printing medium is conveyed, and prints on the basis of input printing data, comprising printing position information generation means for generating printing position information corresponding to a resolution of the printing data, storage means for holding positional shift information of a printing dot on the printing medium in the main scanning direction, position detection means for detecting a position of the printhead which moves in the main scanning direction, and generating a position signal, storage means for storing printing position correction information obtained by correcting, by the positional shift information, the printing position information generated by the printing position information generation means, and printing position signal generation means for outputting a printing position signal for driving the printhead on the basis of the printing position correction information.

To achieve the above object, an image printing apparatus control method according to still another aspect of the present invention has the following steps. That is, there is provided a method of controlling an image printing apparatus which moves a carriage having a printhead in a main scanning direction different from a subscanning direction in which a printing medium is conveyed, and prints on the basis of input printing data, comprising a generation step of generating printing position information corresponding to a resolution of the printing data, a position detection step of detecting a position of the printhead during scanning with respect to the printing medium, and generating a position signal, a positional shift information acquisition step of acquiring positional shift information in the main scanning direction that corresponds to a moving amount of the printing medium in the subscanning direction, a storage step of storing information at an address of storage means that corresponds to a printing position on the printing medium on the basis of the printing position information generated in the generation step and the positional shift information in the main scanning direction, and a printing position signal generation step of accessing the storage means in accordance with input of the position signal, and outputting a printing position signal for driving the printhead.

To achieve the above object, a control program of controlling an image printing apparatus according to still another aspect of the present invention has the following program codes. That is, there is provided a control program of controlling an image printing apparatus which moves a carriage having a printhead in a main scanning direction different from a subscanning direction in which a printing medium is conveyed, and prints on the basis of input printing data, comprising a program code for a generation step of generating printing position information corresponding to a resolution of the printing data, a program code for a position detection step of detecting a position of the printhead during scanning with respect to the printing medium, and generating a position signal, a program code for a positional shift information acquisition step of acquiring positional shift information in the main scanning direction that corresponds to a moving amount of the printing medium in the subscanning direction, a program code for a storage step of storing information at an address of storage means that corresponds to a printing position on the printing medium on the basis of the printing position information generated in the generation step and the positional shift information in the main scanning direction, and a program code for a printing position signal generation step of accessing the storage means in accordance with input of the position signal, and outputting a printing position signal for driving the printhead.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 16 is a flow chart for explaining image printing processing by the inkjet printer according to the second embodiment of the present invention.

DETAILED DESCRIPTION OF THE PREFERRED EMBODIMENTS

Figure 1:
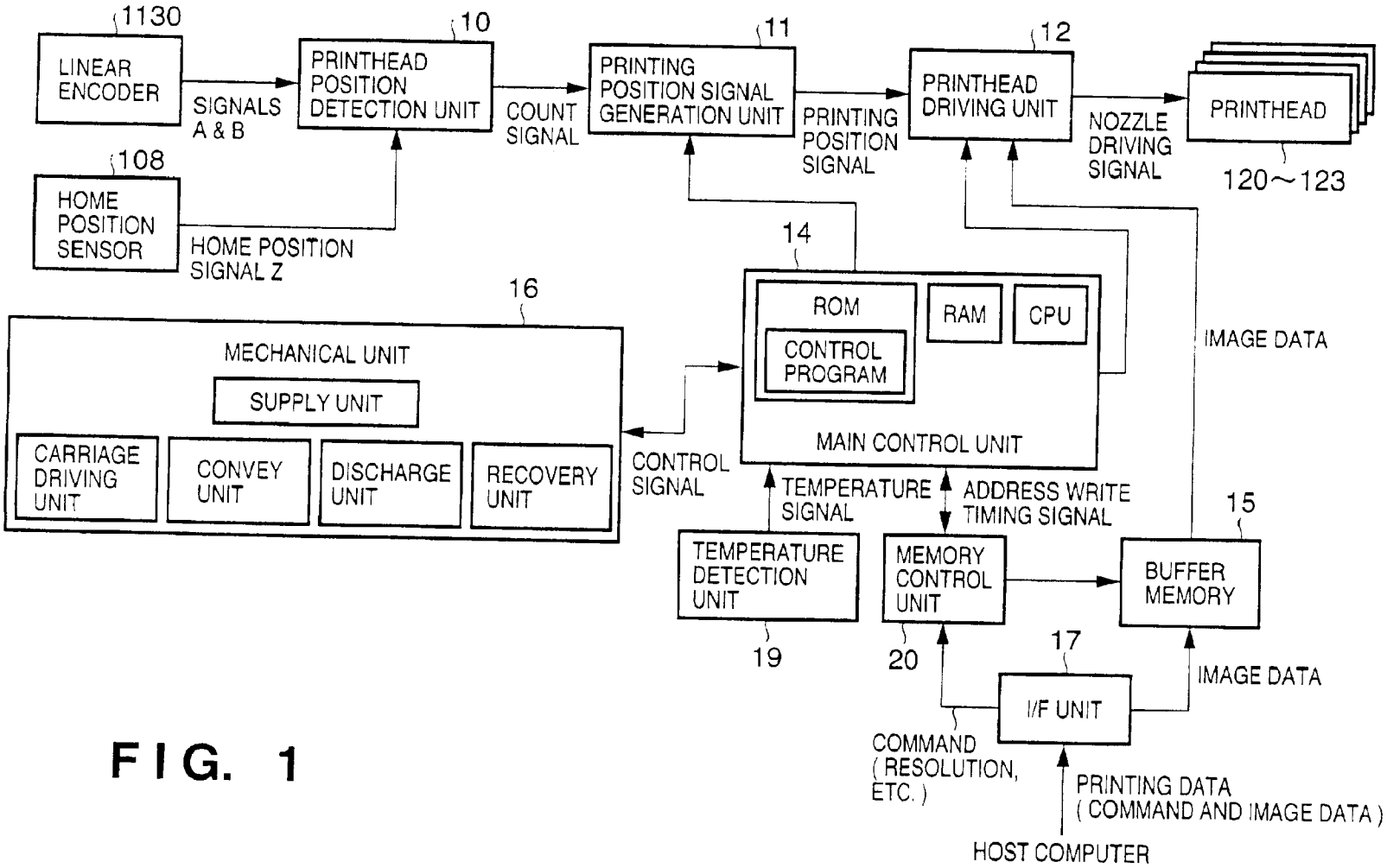
FIG. 1 is a block diagram showing the control arrangement of an inkjet printer according to the first embodiment of the present invention.

Preferred embodiments of the present invention will now be described in detail in accordance with the accompanying drawings.

As described above, the present invention is practiced by various embodiments. Each of the embodiments desirably has, e.g., the following arrangement.

For example, it is preferable that the image printing apparatus further comprises a transfer means, having a buffer memory for storing the printing data and a printhead driving unit, for transferring the printing data from the buffer memory to the printhead driving unit in synchronism with the position signal.

For example, it is preferable that the printing position information generation means generates pieces of printing position information so as to set different positions to which the printhead is driven between forward and return passes of the printhead in the scanning direction, and stores the pieces of generated information in different storage areas of said storage means.

For example, it is preferable that the image printing apparatus further comprises temperature detection means for detecting an ambient temperature of the position detection means, and the printing position information generation means comprises correction means for correcting the printing position information in accordance with the detected ambient temperature.

For example, it is preferable that the image printing apparatus further comprises second storage means for storing positional shift information of a printing dot on the printing medium in the main scanning direction, and the printing position information generation means comprises second correction means for correcting the printing position information on the basis of the positional shift information.

For example, it is preferable that the positional shift information of the printing dot in the main scanning direction includes information on a positional shift generated when the printhead moves in the main scanning direction.

For example, it is preferable that the positional shift information of the printing dot in the main scanning direction includes information on a positional shift generated when the printing medium is moved in the subscanning direction.

For example, it is preferable that the printhead includes a plurality of printheads, and pieces of printing position information are stored in the storage means in correspondence with the printheads.

For example, it is preferable that the image printing apparatus further comprises convey means for conveying the printing medium and convey control means, and the convey means controls a convey amount of the convey means on the basis of positional shift information in the subscanning direction that corresponds to a position of the carriage obtained by said position detection means.

For example, it is preferable that the image printing apparatus further comprises convey means for conveying the printing medium, convey control means, and second position detection means for detecting a position of the printing medium moved in a convey direction, and the convey means controls a convey amount of the convey means on the basis of positional shift information in the subscanning direction that corresponds to the position of the printing medium obtained by the second position detection means.

The following embodiments will exemplify an inkjet printer as a printing apparatus using an inkjet printing method.

In this specification, "printing" (to be also referred to as "drawing" or "print") is to form an image, design, pattern, or the like on a printing medium or process a medium regardless of whether to form significant information such as a character or figure, whether information is significant or insignificant, or whether information is so visualized as to allow a user to visually perceive it.

"Printing media" are not only paper used in a general printing apparatus, but also ink-receivable materials such as cloth, plastic film, metal plate, glass, ceramics, wood, and leather.

"Ink" (to be also referred to as "liquid") should be interpreted as broadly as the definition of "printing (drawing)". "Ink" represents a liquid which is applied to a printing medium to form an image, design, pattern, or the like, process the printing medium, or contribute to ink processing (e.g., solidification or insolubilization of a coloring material in ink applied to a printing medium).

<First Embodiment>

An inkjet printer and control method therefor according to the first embodiment of the present invention will be described.

Figure 8:
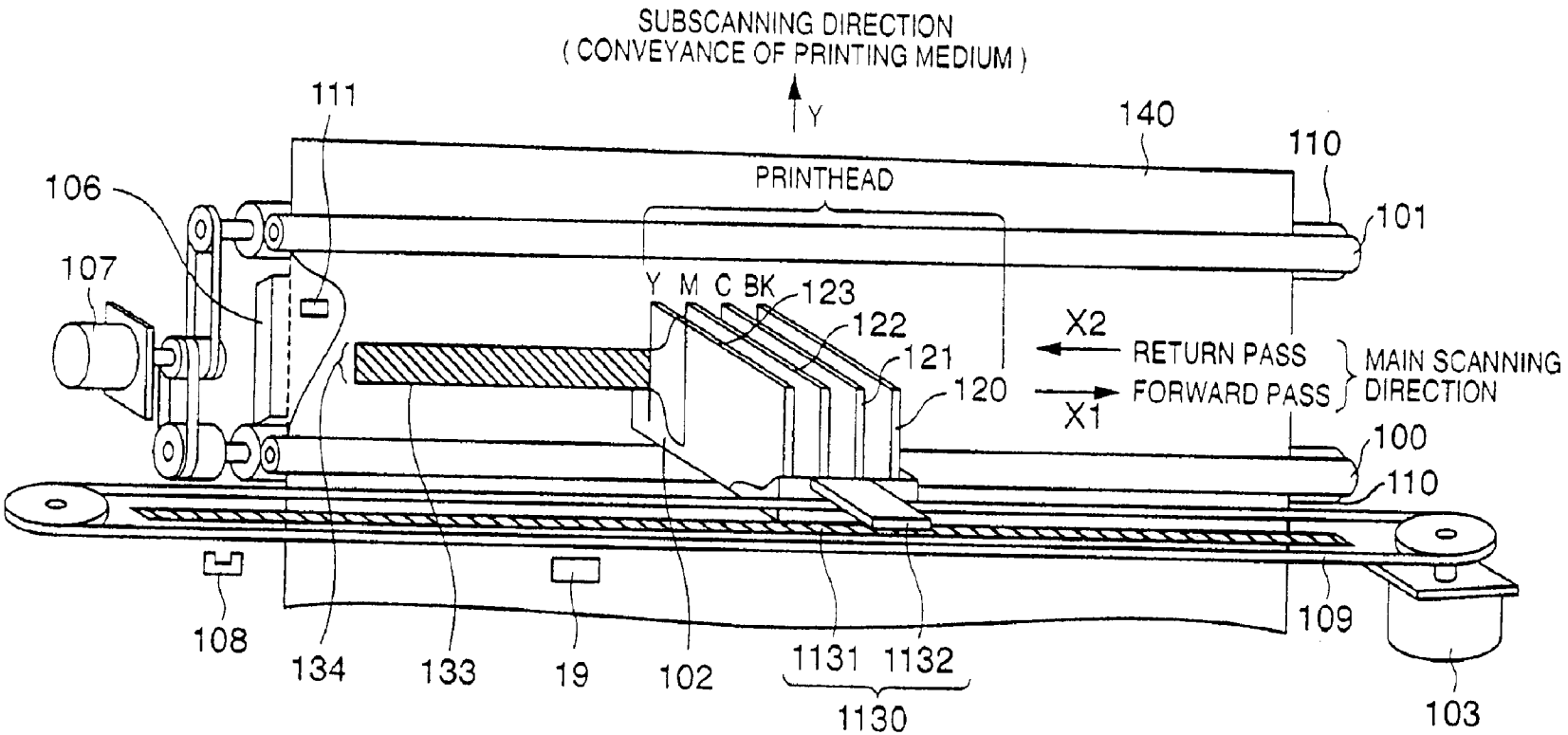
FIG. 8 is a schematic view showing the inkjet printer according to the first embodiment of the present invention.

[Inkjet Printer: FIG. 8]

FIG. 8 is a view showing the whole arrangement of the inkjet printer according to the first embodiment of the present invention.

Figure 9:
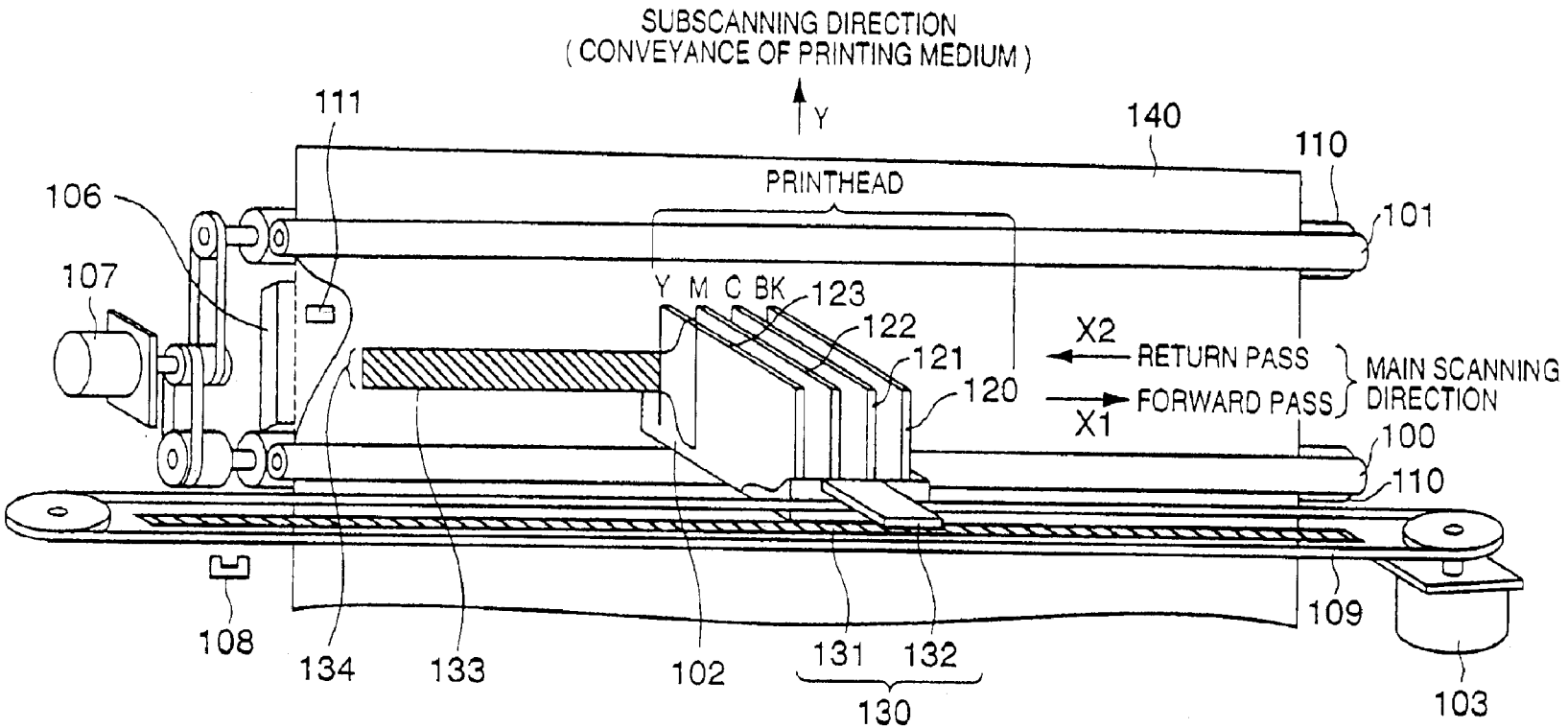
FIG. 9 is a schematic view showing a conventional inkjet printer.

The inkjet printer of the first embodiment shown in FIG. 8 has an arrangement similar to that of the conventional inkjet printer shown in FIG. 9. That is, the inkjet printer shown in FIG. 8 comprises printheads identical to those of the conventional inkjet printer described with reference to FIG. 9, and various mechanisms which control movement of the printheads and the like. This inkjet printer is an inkjet color printer which causes ink to form bubbles by using heat energy, and discharges ink by the bubble pressure.

In the following description, the same reference numerals as in the conventional inkjet printer described with reference to FIG. 9 denote the same parts in the inkjet printer of the first embodiment shown in FIG. 8, a description thereof will be omitted, and only a difference will be explained.

The inkjet printer in FIG. 8 is different from the conventional inkjet printer shown in FIG. 9 in the use of a scale having a high resolving power such that the resolving power of a linear encoder 1130 is 0.5 μm which is several ten times the resolving power of the linear encoder of a conventional inkjet printer (e.g., the resolving power is 21.2 μm for 1,200 dpi). The printhead position can be detected at a precision higher than the conventional one.

In the inkjet printer of the first embodiment, an image can be printed at an arbitrary resolution to be described later on the basis of printhead position information obtained from the linear encoder 1130 having a high resolving power. In addition, a temperature detection unit 19 which detects the ambient temperature is arranged near the installation portion of a scale 1131 of the linear encoder 1130, as shown in FIG. 8. In the inkjet printer of the first embodiment, changes in the scale 1131 of the linear encoder 1130 caused by the ambient temperature can be corrected by the temperature detection unit 19 to print an image at a higher precision.

[Image Printing Operation: FIG. 1]

Image printing operation of the inkjet printer serving as an image printing apparatus according to the first embodiment will be explained with reference to FIG. 1.

FIG. 1 is a block diagram showing the overall inkjet printer according to the first embodiment. A mechanical unit 16 is comprised of a carriage driving unit (carriage 102 and motor 103) which moves printheads 120, 121, 122, and 123 in the main scanning direction (directions X1 and X2), a convey unit (motor 107, roller 101, and like) which conveys a printing medium 140 such as a film or glass substrate in the subscanning direction (Y direction), a supply unit which supplies the printing medium 140, a discharge unit which discharges the printing medium 140, and a recovery unit which recovers the printhead from ink clogging.

A main control unit 14 is a central unit which controls the inkjet printer including the printheads 120 to 123 and the mechanical unit 16. The main control unit 14 comprises a CPU, a ROM which stores various control programs and the like, and a work RAM which allows writing/reading out various data.

The main control unit 14 outputs a control signal to the mechanical unit 16 to perform mechanical control such as movement of the carriage 102 and movement of the printing medium 140. The main control unit 14 frequently exchanges signals with a printhead driving unit 12, memory control unit 20, and printing position signal generation unit 11, thereby controlling driving of the printheads 120, 121, 122, and 123.

An I/F unit 17 is an interface between a host computer (not shown) and the inkjet printer, and receives a command and image data from the host computer.

The memory control unit 20 transfers a command input from the I/F unit 17 to the main control unit 14, and generates an address and write timing signal so as to write image data in a buffer memory 15 under the control of the main control unit 14. The temperature near the scale 1131 of the linear encoder 1130 that is detected by the temperature detection unit 19 is transmitted to the main control unit 14.

The main control unit 14 interprets a command input from the I/F unit 17, and sets image printing conditions such as the image printing speed and image printing resolution on the basis of the interpretation result. The main control unit 14 controls the mechanical unit 16 and printing position signal generation unit 11 under the image printing conditions, and prints an image under desired conditions.

Image data received from the host computer (not shown) is stored in the buffer memory 15 serving as a temporary memory, and transferred to the printhead driving unit 12 under the control of the memory control unit 20 which has received an instruction from the main control unit 14.

The printhead driving unit 12 drives each nozzle of the printhead in accordance with image data (printing data) transferred from the buffer memory 15 in synchronism with an image printing position signal output from the printing position signal generation unit 11, thereby printing an image.

The buffer memory 15 is constituted by a memory having a storage capacity enough to store image data of one band or more necessary to print an image by scanning the printheads

120, 121, 122, and 123 once in the main scanning direction. Data of one band is stored in a column format corresponding to the nozzle layout.

For example, the number of nozzles of each printhead in the subscanning direction is 128, and the maximum number of dots by which an image can be printed by one scanning operation in the main scanning direction is 8 k. In this case, the buffer memory 15 has a storage capacity of 128 (nozzles)×8,000 (dots)×4 (colors)=4,096,000 (4 Mbits or more).

Because of a large amount of image data to be transferred and the need for high throughput of the inkjet printer, the I/F unit 17 may be a high-speed interface such as a Centronics interface, SCSI interface, or recent IEEE 1394 interface.

The mechanical unit 16 of the first embodiment drives by the motor a driving belt 109, a second feed roller 100, and the second feed roller 101 as a carriage driving means and printing medium convey means. When a higher image printing precision is required, an X-Y stage which is directly moved by a linear motor may be used.

Figure 2A:
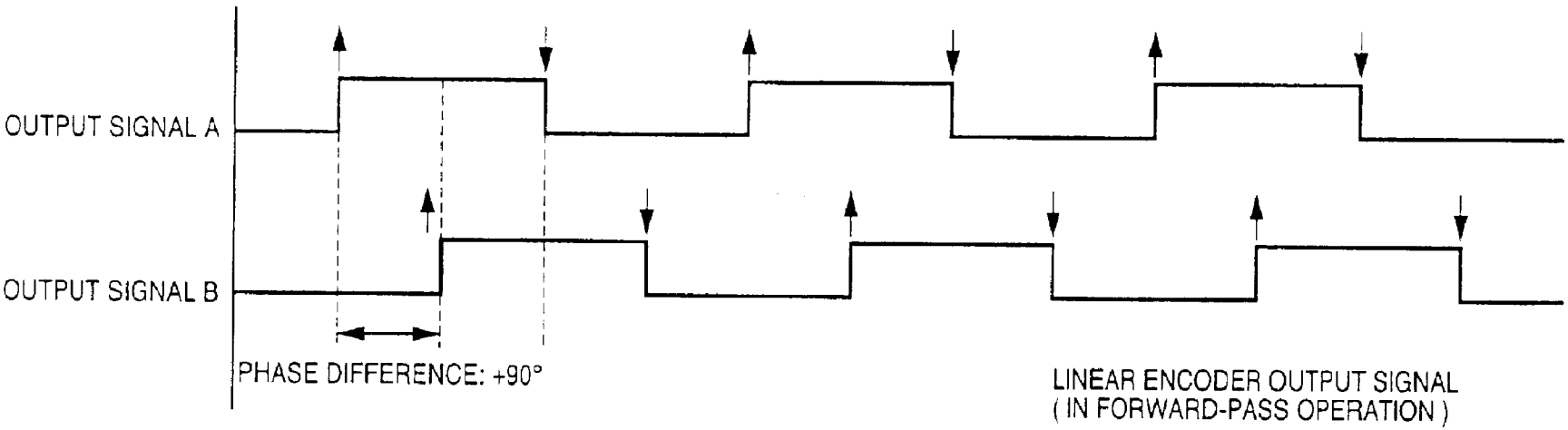
FIG. 2A is a chart showing an output signal when a linear encoder according to the embodiment operates in the forward pass in the main scanning direction.
Figure 2B:
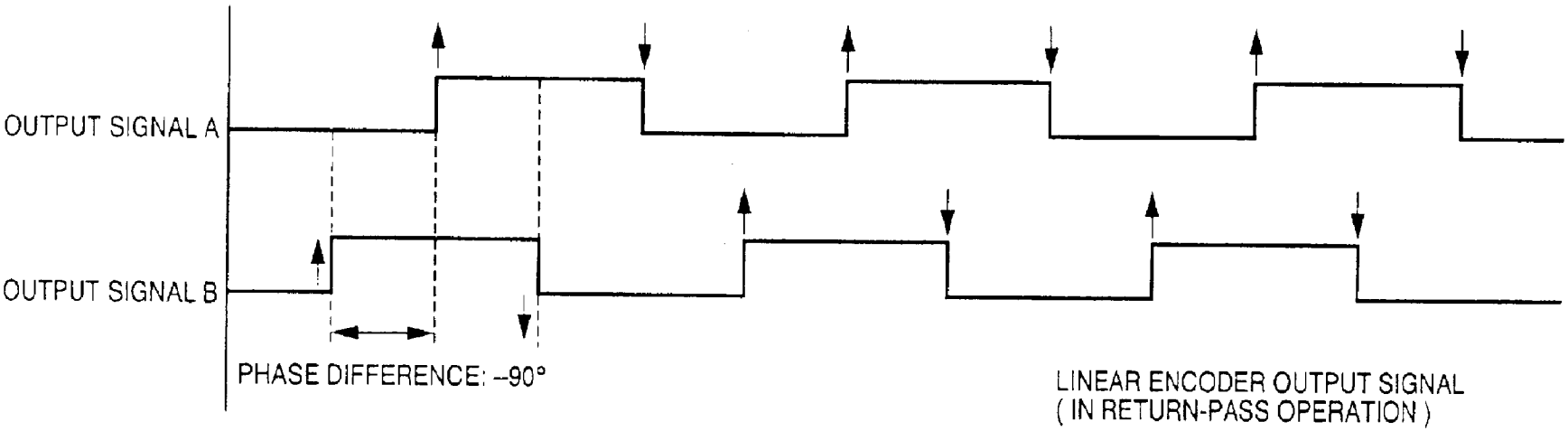
FIG. 2B is a chart showing an output signal when the linear encoder according to the embodiment operates in the return pass in the main scanning direction.

[Image Printing Position Control Method: FIGS. 2A and 2B]

An image printing position control method at an arbitrary resolution corresponding to the image data resolution which is a feature of the present invention will be described.

FIGS. 2A and 2B are charts showing the output signal of the linear encoder 1130. The linear encoder 1130 generates two signals A and B having a phase difference of 90°. FIG. 2A shows signals A and B generated when the carriage 102 moves in the forward pass. FIG. 2B shows signals A and B generated when the carriage 102 moves in the return pass.

When the phase of signal A leads by 90° from that of signal B, as shown in FIG. 2A, the carriage 102 moves in the forward pass, and signals are counted up in response to the leading and trailing edges of each signal. When the phase lags behind by 90°, as shown in FIG. 2B, the carriage 102 moves in the return pass, and signals are counted down. In this manner, the position of the carriage 102 can be detected.

A printhead position detection unit 10 in FIG. 1 receives two signals A and B from the linear encoder 1130 and a home position signal Z output from a home position sensor 108, and actually detects the absolute position of the carriage 102 in the main scanning direction.

Figure 3:
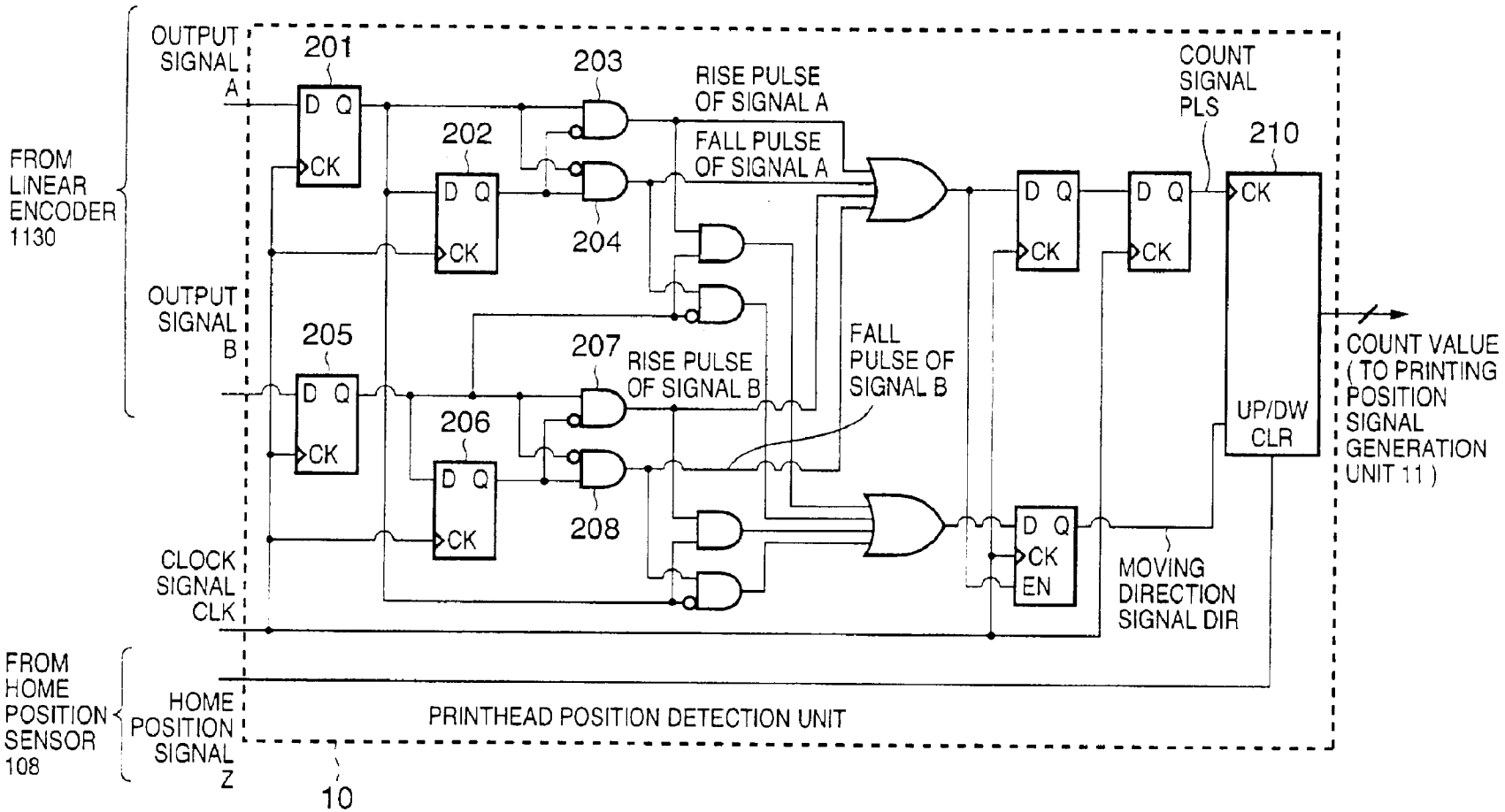
FIG. 3 is a diagram showing an example of the circuit of a printhead position detection unit according to the embodiment.

[Printhead Position Detection Unit: FIG. 3]

FIG. 3 shows an example of the circuit of the printhead position detection unit 10. The printhead position detection unit 10 generates a count signal (PLS), and an up/down signal, i.e., moving direction signal (DIR) on the basis of signals A and B from the linear encoder 1130, the home position signal Z from the home position sensor 108, and a clock (CLK) for establishing logic timing synchronization.

A circuit constituted by building components 201 to 204 in FIG. 3 detects the rise and fall timings of signal A. A pulse which is synchronized with the rise timing of signal A is output from the output of the component 203. A pulse which is synchronized with the fall timing is output from the output of the component 204.

Similarly, a circuit constituted by building components 205 to 208 in FIG. 3 detects the rise and fall timings of signal B. A pulse which is synchronized with the rise timing of signal B is output from the output of the component 207. A pulse which is synchronized with the fall timing is output from the output of the component 208.

Figure 4:
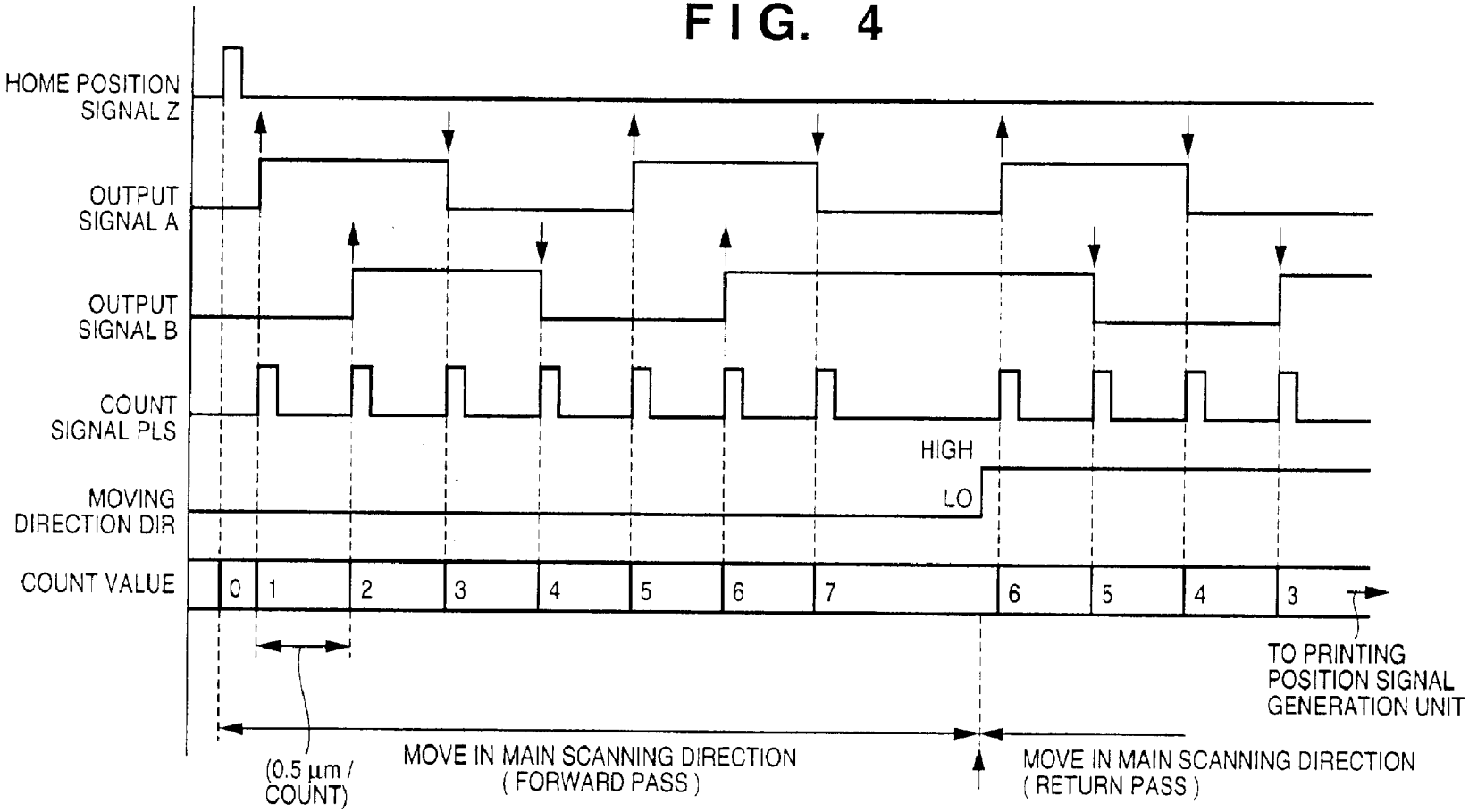
FIG. 4 is a timing chart showing an example of the timing of the position detection unit according to the embodiment.

[Timing Chart: FIG. 4]

FIG. 4 is a timing chart.

In FIG. 4, the phase of signal A leads from that of signal B by 90° at the beginning, and the moving direction signal DIR exhibits the forward direction (LO level). The phase lags behind by 90° from the middle of FIG. 4, and the moving direction signal DIR exhibits the return direction (HIGH level).

A count signal PLS exhibits that pulses are output at the rise and fall timings of two signals A and B, and the carriage moves by 0.5 μm every time one pulse is generated. That is, the absolute position of the carriage in the main scanning direction can be detected at a high precision of 0.5 μm/count.

These signals, i.e., the home position signal Z, count signal PLS, and moving direction signal DIR are supplied to the reset (CLR), clock (CK), and up/down (UP/DW) inputs of an up/down counter 210 shown in FIG. 3.

When the carriage 102 moves to the home position in accordance with an initialization instruction from the main control unit 14, the home position signal Z becomes active, and the count output is cleared (count value=0). After that, the count value=0 is set as a home position, and the carriage position is output as a count value to the printing position signal generation unit 11.

Figure 5:
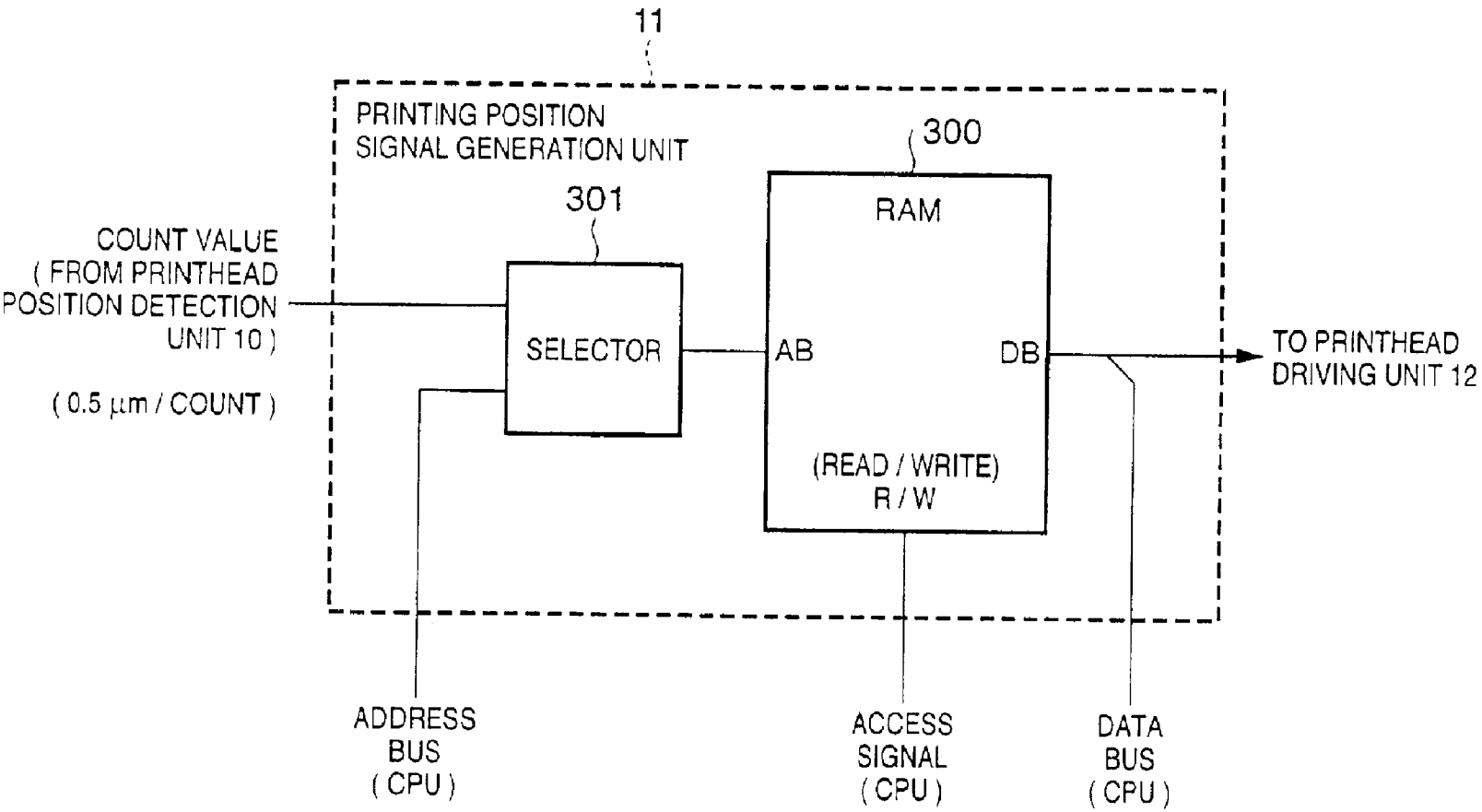
FIG. 5 is a block diagram showing a position generation unit according to the embodiment.

[Printing Position Generation Unit: FIG. 5]

FIG. 5 is a block diagram showing the printing position signal generation unit 11. A count value generated by the printhead position detection unit 10 in FIG. 3 is input via a selector 301 to an address input for accessing the memory area of a corresponding address in a RAM 300.

The address bus is connected to the address input AB of the RAM 300 via the other input of the selector 301 so as to directly read/write data in/from the memory area of each address in the RAM 300 by the CPU of the main control unit 14. A data bus is connected to the data bus DB of the RAM 300, and an access signal is input to the input R/W of the RAM 300.

To write data in each predetermined area of the RAM 300 from the main control unit 14, the selector 301 is switched to the CPU. During image printing operation, the selector 301 is so switched as to input a count value to the address input of the RAM 300. Data (printing position data) stored at an address of the RAM 300 that corresponds to the carriage position (count value) is output to the printhead driving unit 12 along with movement of the carriage 102.

Printing position data from the CPU of the main control unit 14 is stored in the RAM 300 in advance, and data at addresses of the RAM 300 are sequentially read out along with carriage movement. At an address corresponding to a printing position, "1" is stored as printing position data. "1" is read out to output a printing position pulse to the printhead driving unit 12. Upon reception of this printing position pulse, the printhead driving unit 12 drives the printheads 120 to 123 to discharge ink onto the printing medium 140.

For example, when printing of 2,880 columns is done in one main scanning printing operation, 2,880 printing position data "1" are stored in the RAM 300. Every time printing position data "1" is read out, printing data of one column is read out from an address of the buffer memory 15 that corresponds to the printing position.

Figure 6:
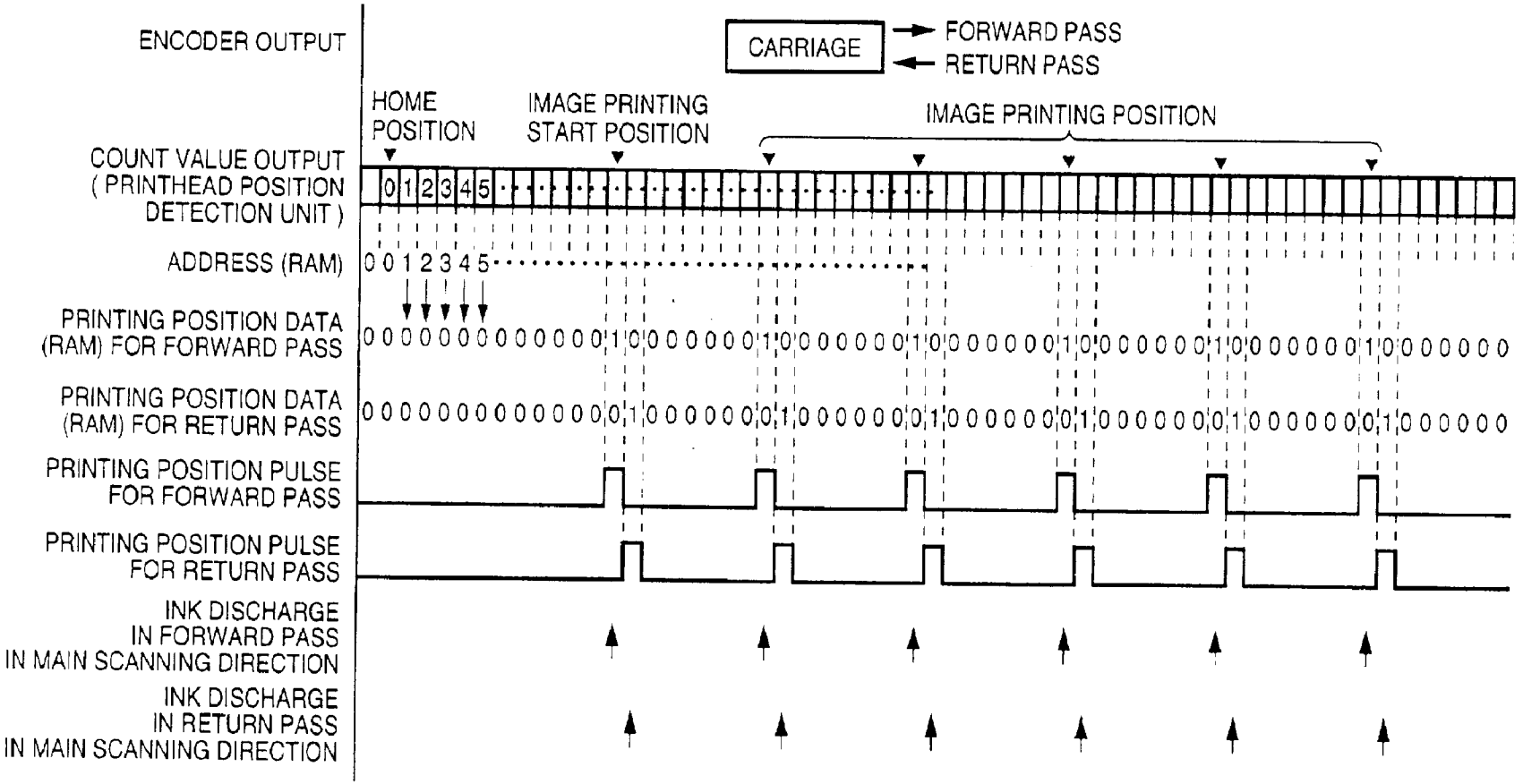
FIG. 6 is a chart for explaining the operation of the position generation unit according to the embodiment.

[Printing Position Pulse: FIG. 6]

FIG. 6 is a timing chart showing the timing of the printing position pulse. By this printing pulse, the read address is changed to sequentially read out printing position data stored in the RAM 300 in synchronism with, e.g., the count value output.

In FIG. 6, an address (RAM) and printing position data (RAM) respectively represent an address of the RAM 300 and printing position data stored at the address. FIG. 6 shows how data of two bits in the forward and return passes are written in the RAM 300.

When the carriage moves in response to a pulse signal which gives a printing timing to the printhead driving unit 12, bits corresponding to the forward and return passes in the main scanning direction are selected, as shown in FIG. 6, thus obtaining separate pulse outputs from the printing position pulse in FIG. 6.

The output timings of pulses for the forward and return passes in the main scanning direction in FIG. 6 do not coincide with each other. This is because, even if the printhead is driven at the same timing in the forward and return passes in the main scanning direction, a predetermined time is required until an ink droplet discharged from the printhead reaches a printing medium, and the ink droplet landing position shifts between the forward and return passes in the main scanning direction. Hence, different storage addresses in the RAM 300 are used to set the timing of the printing position pulse so as to obtain different timings between the forward and return passes in the main scanning direction. That is, the RAM 300 has an area where printing position data for the forward pass is stored, and an area where printing position data for the return pass is stored.

FIG. 6 shows the timing of the printing position pulse in bi-directional image printing of printing an image in the forward and return passes in the main scanning direction. In, for example, one-way image printing of printing an image in only the forward pass, all bits in the return pass are set to 0. In this case, when the carriage moves in the return pass, no printing position pulse is output.

For descriptive convenience, FIG. 6 shows only one set of data in the RAM 300 and printing position pulses for the forward and return passes. When the four printheads 120 to 123 are used, like the first embodiment, the number of data bits of the RAM 300 is increased to ensure areas for four sets of printing position data and store printing position data corresponding to each printhead. Printing position pulses are independently generated for the printheads 120 to 123.

[Printing Position Data Creation Method]

The method of generating an image printing timing to be output to the printhead driving unit 12 at a high precision of 0.5 μm/count has been described. A creation method of writing printing position data corresponding to each resolution in the RAM 300 so as to print an image at a resolution corresponding to the resolution of received printing data will be explained.

An image printing position data creation method when an image is simply printed at a resolution designated by printing data will be described.

Letting Ls be the image printing start position [μm], Pr be the resolution pitch [μm], Er be the resolving power [μm] of the linear encoder, and An be an address of the RAM that corresponds to the nth position from the image printing start position, i.e., the image printing position of the nth column, An is given by $$An=(Ls+n\times Pr)/Er \quad (1)$$

After all the contents of the RAM 300 are cleared to 0, An is calculated for all n image printing positions in accordance with equation (1). "1"s representing image printing are written at desired bits of data corresponding to the addresses An of the RAM 300. Image printing pulses can be generated at a desired image printing resolution. Image data is read out from the buffer memory in correspondence with read of "1" of printing position data stored in the RAM 300. The image data is transferred to the printhead driving unit. Ink is discharged from the nozzle of the printhead in correspondence with the image data value.

The inkjet printer according to the first embodiment can detect the printhead position at a high precision of 0.5 μm/count. In printing an image from received printing data by using equation (1), image printing position data suitable for the resolution of printing data can be generated. One inkjet printer can print an image at the resolutions of both the 300- and 360-dpi systems, which cannot be realized by a conventional inkjet printer.

[Correction of Error Caused by Thermal Expansion of Encoder Scale]

A method of correcting an error of printing position data caused by thermal expansion of the encoder scale, and printing an image at a high precision will be explained.

As described above, the temperature detection unit 19 is arranged near the encoder scale 1131, and temperature data can be loaded into the main control unit 14. The main control unit 14 corrects printing position data on the basis of the temperature value, thereby correcting an error caused by thermal expansion of the encoder scale.

Letting T be the temperature value [° C.] represented by the temperature detection unit 19, To be the temperature [° C.] obtained by measuring calibration data of the encoder, i.e., the reference temperature, and k be the thermal expansion coefficient of the encoder scale 1131, An is given by $$An=(Ls+n\times Pr)\times\{1+k\times(T-To)\}/Er \quad (2)$$

By the same method as that described in the absence of thermal expansion, An is calculated for all n image printing positions. "1"s representing image printing are written at desired bits of data corresponding to the addresses An of the RAM 300. As a result, an error by thermal expansion of the encoder scale 1131 is corrected, and an image is printed at a correct position.

[Correction of Shift of Position Signal of Linear Encoder]

Figure 7:
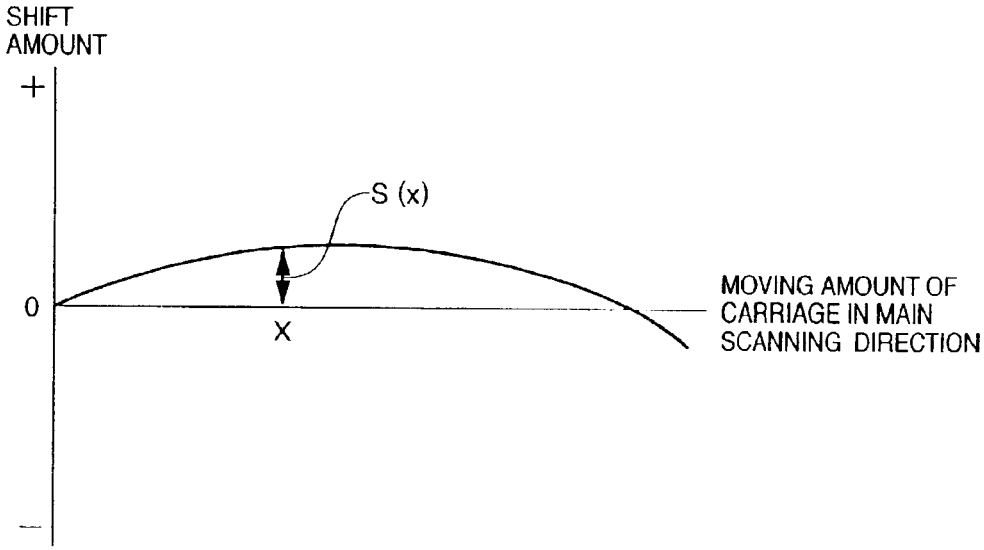
FIG. 7 is a graph showing an example of a shift amount S(x) with respect to a moving amount x of the carriage of the linear encoder in the main scanning direction according to the first embodiment of the present invention.

A method of correcting printing position data and printing an image at a high precision when the position signal of the linear encoder is output with a shift from an actual carriage moving amount, as shown in FIG. 7, owing to the component/assembly precision or scale patterning precision in manufacturing an encoder will be described.

In FIG. 7, the abscissa represents the actual moving amount (x) of the carriage 102 in the main scanning direction, and the ordinate represents the shift amount (S(x)) of each position signal of the linear encoder 130 from a true value. S(x) is a function.

Letting S(x) be the main scanning shift amount (position shift amount) from the true value for a moving amount x from the home position of the carriage 102 in the main scanning direction, the shift amount at the nth image printing position from the image printing start position is S(Ls+n×Pr). Hence, An is given by $$An=\{(Ls+n\times Pr)-S(Ls+n\times Pr)\}/Er \quad (3)$$

[Correction of Error Caused by Thermal Expansion+Correction of Shift of Position Signal]

Correction of an error caused by thermal expansion of the linear scale 131 is added to correction of the position signal of the linear encoder that is output with a shift:

$$An=\{(Ls+n\times Pr)-S(Ls+n\times Pr)\}\times\{1+k\times(T-To)\}/Er \quad (4)$$

An error caused by thermal expansion of the encoder scale 131 and the shift of the position signal of the carriage (printhead) can be simultaneously corrected at an arbitrary image printing resolution.

The relationship (FIG. 7) between the shift amount S(x) and the moving amount x of the carriage in the main scanning direction is obtained in advance by actually measuring the shift amount S(x) from the true value for each moving amount x while moving the carriage. The shift amount is stored in a storage means to facilitate correction. The shift amount measurement method can be achieved using a known position measurement method.

In the first embodiment, the resolving power of the linear encoder 130 is 0.5 μm, and the image printing position setting has an error of ±0.5 μm at maximum. The error of ±0.5 μm at maximum is merely ±5% (i.e., ±0.53 μm or less) of a 10.6-μm resolution pitch at 2,400 dpi. If the resolution will increase in the future, a linear encoder with a resolving power of, e.g., 0.1 μm can be used to make an error fall within the allowable range (e.g., about ±0.1 μm).

In the above-described inkjet printer of the first embodiment, the carriage moving range is about 600 mm in order to cope with a 14" liquid crystal filter. The capacity of the RAM 300 used in the printing position signal generation unit 11 is 600 mm/0.5 μm. This capacity is about 1.2 Mbytes, which can be implemented by several 4-Mbit static memories.

The first embodiment has exemplified a color inkjet printer having a plurality of printheads. The present invention is not limited to a color inkjet printer, and can also be applied to a commercially available inkjet printer, an image printing apparatus of another image printing type such as a thermal transfer image printing apparatus, and a general printer. The present invention is not particularly limited to the above embodiment.

Figure 10:
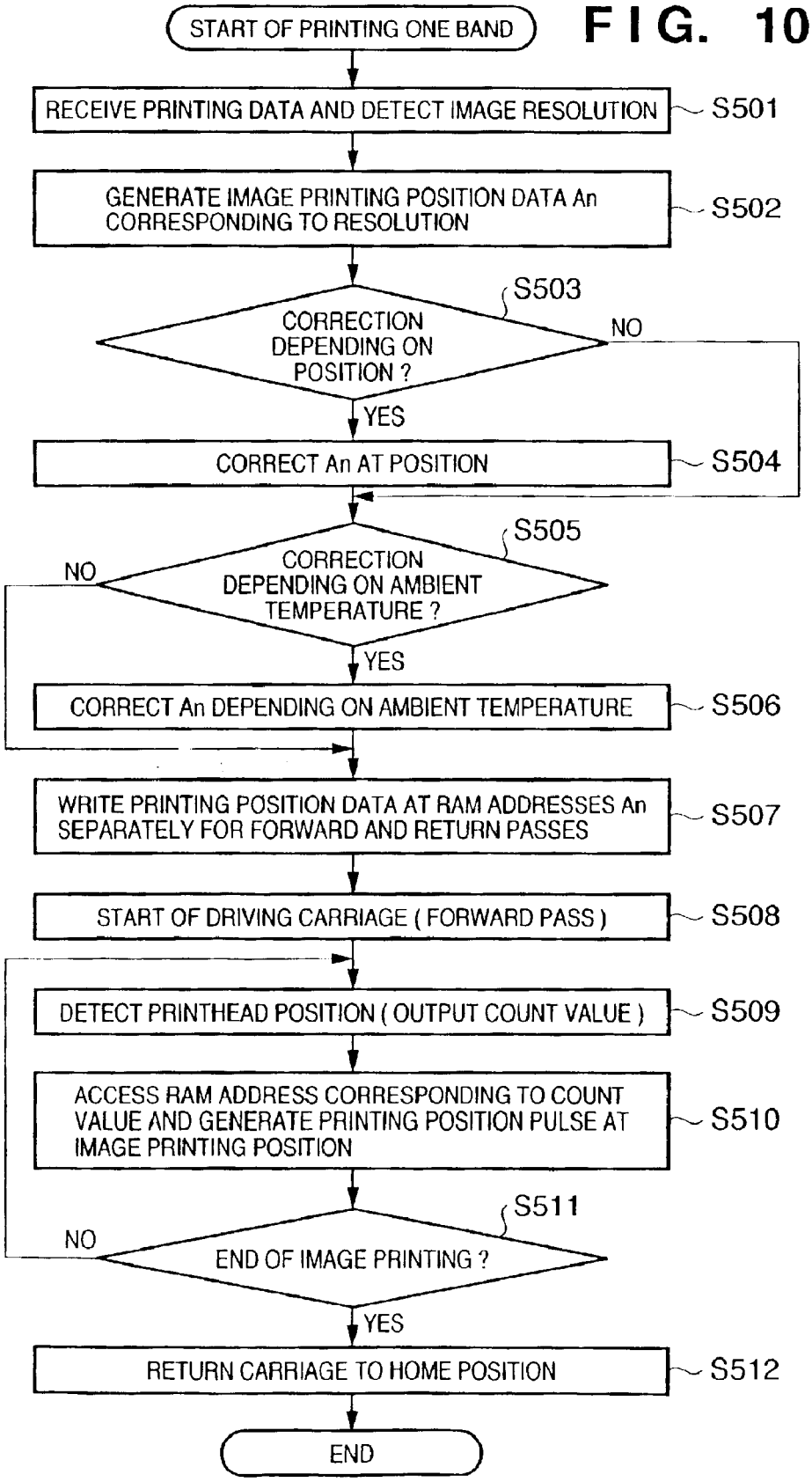
FIG. 10 is a flow chart for explaining image printing processing by the inkjet printer according to the first embodiment of the present invention.

[Image Printing Processing: FIG. 10]

FIG. 10 shows processing of printing in only the forward pass in the scanning direction (one-way printing) as an example of image printing processing by the above-described inkjet printer of the first embodiment. FIG. 10 shows processing of detecting the resolution of received printing data and performing image printing suitable for the resolution in creating an image from the received printing data. Also, FIG. 10 shows processing of correcting a read error at an image printing position upon changes in ambient temperature, and processing of correcting a position shift at each position of the printhead, in order to print an image at a high precision. Image printing processing in FIG. 10 is merely an example. By applying processing in FIG. 10, the present invention can also be applied to printing in both the forward and return passes in the scanning direction (bi-directional printing).

Processing in FIG. 10 is executed by the main control unit 14 using the RAM as a work area on the basis of a control program stored in the ROM of the main control unit 14 while controlling each unit. An example of this processing will be explained in detail.

In step S501, if printing data is received, the printing data is stored in the memory, and the resolution of an image to be printed is detected from the printing data.

In step S502, the nth image printing position An from the image printing start position is generated as image printing position data corresponding to the detected resolution so as to perform image printing suitable for the detected resolution.

In step S503, whether correction at each position is performed for the image printing position data is determined. If correction is performed (YES in step S503), the flow advances to step S504 to perform position correction, and then to step S505. If no position correction is performed (NO in step S503), the flow advances to step S505 without any processing.

If correction depending on the ambient temperature is performed for the printing position data (YES in step S505), the flow advances to step S506 to perform correction depending on the ambient temperature, and then to step S507. If no correction depending on the ambient temperature is performed (NO in step S505), the flow directly advances to step S507.

In step S507, "1"s are written at RAM addresses An separately for the forward and return passes in the printhead scanning direction ("1" represents a printing position, and "0" represents no printing position).

If driving of the carriage starts in step S508, the printing position is detected in step S509 to output a count value. In step S510, a RAM address corresponding to the count value is accessed, and if the address represents an image printing position, a printing position pulse is generated to print an image. Thereafter, the flow advances to step S511.

If image printing of one band has not ended in step S511, the flow returns to step S509 to repeat the above-described processing. If image printing of one band ends, the flow advances to step S512 to return the carriage to the home position and end a series of processes.

As described above, the inkjet printer of the first embodiment can use a high-resolving-power linear encoder to detect a printhead position at a precision several ten times that of a conventional inkjet printer. In printing an image from received printing data, image printing position data suitable for the resolution of the received printing data can be generated to print an image. One inkjet printer can print an image at the resolutions of both the 300- and 360-dpi systems. An image can also be printed at another resolution if the memory capacity and memory access permit. As printing position information, "1" represents a printing position, and "0" represents a non-printing position. However, another data may be adopted. Image printing may be controlled using "0" as a printing position and "1" as a non-printing position.

If necessary, a linear encoder error caused by the ambient temperature can be corrected. The shift of a position signal caused by the component/assembly precision and scale patterning precision in manufacturing an encoder can also be corrected. As a result, an image can be printed at a higher precision.

<Second Embodiment>

An inkjet printer and control method therefor according to the second embodiment of the present invention will be described. In the following description, the same reference numerals as in the inkjet printer of the first embodiment denote the same parts, a description thereof will be omitted, and only a difference will be explained.

Figure 11:
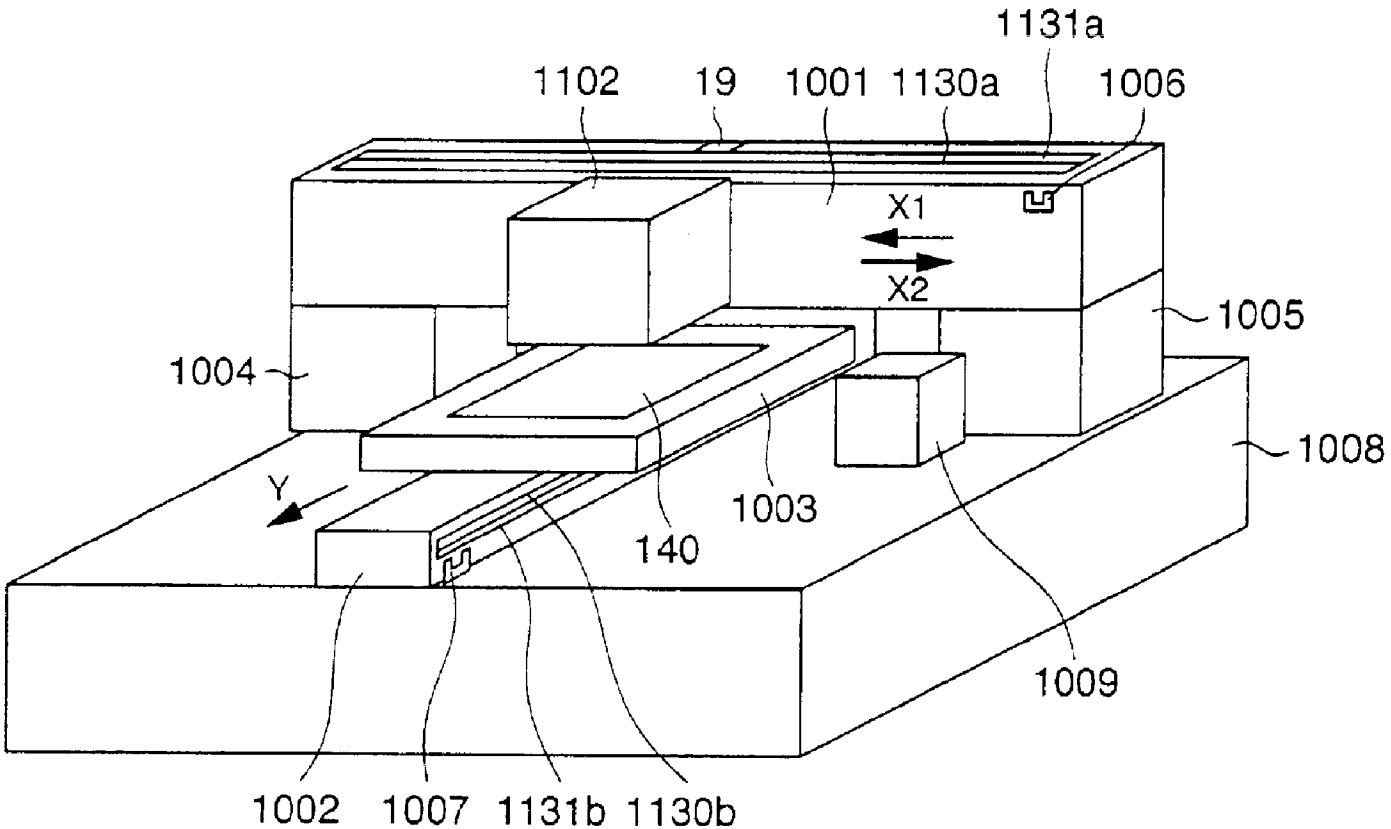
FIG. 11 is a schematic view showing an inkjet printer according to the second embodiment of the present invention.

[Arrangement of Image Printing Apparatus: FIG. 11]

FIG. 11 is a view showing the whole arrangement of the inkjet printer according to the second embodiment of the present invention. The inkjet printer shown in FIG. 11 is so devised as to reduce the position shift of an ink landing position on a printing medium, compared to the conventional inkjet printer shown in FIG. 9.

This will be described in detail. The resolving powers of linear encoders 1130*a* and 1130*b* in the second embodiment are 0.5 μm, which is several ten times higher than the resolving power of the conventional inkjet printer in FIG. 9 (e.g., the resolving power is 21.2 μm for 1,200 dpi). To detect a printhead position at a high precision, the inkjet printer in FIG. 11 employs a high-precision CR linear motor 1001 as a moving means for a carriage 1102 and printing medium 140. The printing medium 140 is fixed onto a stage 1003 having a high surface precision, and then moved.

More specifically, in the conventional inkjet printer, the carriage 102 is moved in the main scanning direction by the motor 103 and driving belt 109. In the inkjet printer of the second embodiment, the high-precision CR linear motor 1001 is used as a moving means for the carriage 1102. In the inkjet printer of the second embodiment, the printing medium 140 is fixed onto the stage 1003 having a high surface precision, and moved using a high-precision LF linear motor 1002, instead of the feed motor 107 and the feed rollers 106 and 110 used as a moving means for the printing medium 140 in the conventional inkjet printer.

The LF linear motor 1002 is firmly fixed to a surface plate 1008 so as to always keep the stage surface holding the printing medium 140 and the surface of the surface plate parallel even if the stage 1003 moves. The CR linear motor 1001 is fixed on the surface plate 1008 via bases 1004 and 1005 at a high precision and high rigidity, and is so adjusted as to move the carriage 1102 parallel to the surface of the surface plate, i.e., the stage surface. The CR linear motor 1001 and LF linear motor 1002 respectively incorporate the linear encoders 1130*a* and 1130*b*, and home position sensors 1006 and 1007. The linear encoders 1130*a* and 1130*b* and the home position sensors 1006 and 1007 are used as servo control inputs in moving the linear motors. The linear encoder 1130*a* on the CR side is used to generate an ink discharge timing, similar to the conventional inkjet printer. Reference numeral 19 denotes a temperature sensor; and 1009, a recovery unit which recovers the printhead from ink clogging. The temperature detection unit 19 can correct changes in a scale 1131*a* of the linear encoder 1130*a* and a scale 1131*b* of the linear encoder 1130*b* caused by the ambient temperature.

Figure 12:
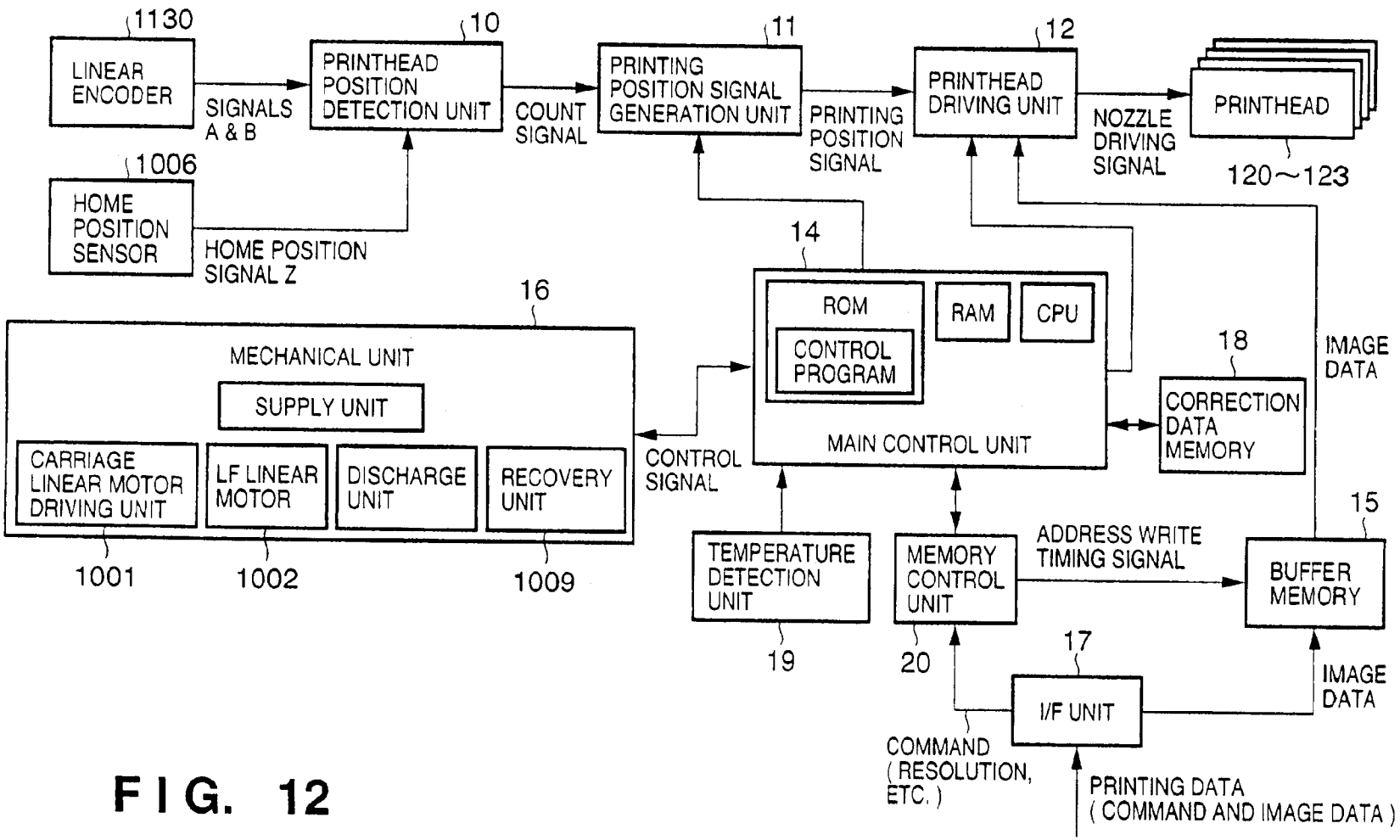
FIG. 12 is a block diagram showing the control arrangement of an inkjet printer according to the second embodiment of the present invention.

[Image Printing Operation: FIG. 12]

Image printing operation of the inkjet printer according to the second embodiment will be explained with reference to FIG. 12.

FIG. 12 is a block diagram showing the overall inkjet printer according to the second embodiment. A mechanical unit 16 is comprised of the CR linear motor 1001 which moves printheads 120, 121, 122, and 123 in the main scanning direction (directions X1 and X2), the LF linear motor 1002 which conveys the stage 1003 holding the printing medium 140 such as a film or glass substrate in the subscanning direction (Y direction), and the recovery unit 1009 which recovers the printhead from ink clogging.

A main control unit 14 is a central unit which controls the inkjet printer including the printheads 120 to 123 and the mechanical unit 16. The main control unit 14 comprises a CPU, a ROM which stores various control programs and the like, and a work RAM which allows writing/reading out various data.

The main control unit 14 outputs a control signal to the mechanical unit 16 to perform mechanical control such as movement of the carriage 102 and movement of the printing medium 140. The main control unit 14 frequently exchanges signals with a printhead driving unit 12, memory control unit 20, and printing position signal generation unit 11, thereby controlling driving of the printheads 120, 121, 122, and 123.

An I/F unit 17 is an interface between a host computer (not shown) and the inkjet printer, and receives a command, image data, and correction data to be described later from the host computer.

The memory control unit 20 transfers a command input from the I/F unit 17 to the main control unit 14, and generates an address and write timing signal so as to write image data in a buffer memory 15 under the control of the main control unit 14. The temperatures near the scales 1131*a* and 1131*b* of the linear encoders 1130*a* and 1130*b* that are detected by the temperature detection unit 19 are transmitted to the main control unit 14.

A correction data memory 18 stores, as a table, ink landing position shift data at the moving positions of the CR linear motor (main scanning direction) and LF linear motor (subscanning direction). The main control unit 14 refers to the landing position shift data to perform control of correcting position shift amounts in the main scanning direction and subscanning direction.

The main control unit 14 interprets a command input from the I/F unit 17, and sets image printing conditions such as the image printing speed and image printing resolution on the basis of the interpretation result. The main control unit 14 controls the mechanical unit 16 and printing position signal generation unit 11 under the image printing conditions, and prints an image under desired conditions.

Image data received from the host computer (not shown) is stored in the buffer memory 15 serving as a temporary memory, and transferred to the printhead driving unit 12 under the control of the memory control unit 20 which has received an instruction from the main control unit 14.

The printhead driving unit 12 drives each nozzle of the printhead in accordance with image data transferred from the buffer memory 15 in synchronism with an image printing position signal output from the printing position signal generation unit 11, thereby printing an image.

The buffer memory 15 is constituted by a memory having a storage capacity enough to store image data of one band or more necessary to print an image by scanning the printheads 120, 121, 122, and 123 once in the main scanning direction. Data of one band is stored in a column format corresponding to the nozzle layout.

For example, the number of nozzles of each printhead in the subscanning direction is 128, and the maximum number of dots by which an image can be printed by one scanning operation in the main scanning direction is 8 k. In this case, the buffer memory 15 has a storage capacity of 128 (nozzles)×8,000 (dots)×4 (colors)=4,096,000 (4 Mbits or more).

Because of a large amount of image data to be transferred and the need for a higher drawing speed, the I/F unit 17 may be a high-speed interface such as a Centronics interface, SCSI interface, or recent IEEE 1394 interface.

[Image Printing Position Control: FIGS. 2A to 6]

An image printing position control method in the inkjet printer according to the second embodiment will be described. The image printing position control method in the inkjet printer according to the second embodiment is the same as that in the inkjet printer according to the first embodiment described with reference to FIGS. 2A to 6, and a repetitive description of FIGS. 2A to 6 will be omitted.

[Printing Position Data Creation Method]

The method of generating an image printing timing to be output to the printhead driving unit 12 has been described. A method of creating printing position data to be written in the RAM 300 will be explained.

An image printing position data creation method when an image is simply printed at a resolution designated by printing data will be described.

Letting Ls be the image printing start position [μm], Pr be the resolution pitch [μm], Er be the resolving power [μm] of the linear encoder, and An be an address of the RAM that corresponds to the nth position from the image printing start position, i.e., the image printing position of the nth column, An is given by $$An=(Ls+n\times Pr)/Er \quad (5)$$

After all the contents of the RAM 300 are cleared to 0, An is calculated for all n image printing positions in accordance with equation (5). "1"s representing image printing are written at desired bits of data corresponding to the addresses An of the RAM 300. Image printing pulses can be generated at a desired image printing resolution.

The inkjet printer according to the second embodiment can also detect the printhead position at a high precision of 0.5 μm/count. In printing an image from received printing data by using equation (5), image printing position data suitable for the resolution of printing data can be generated. One inkjet printer can print an image at the resolutions of both the 300- and 360-dpi systems, which cannot be realized by a conventional inkjet printer.

[Method of Correcting Moving Errors of Carriage and Printing Medium Moving Means]

A method of correcting a position shift of the landing position of ink printed on a printing medium by using two moving errors of the carriage and printing medium moving means in the inkjet printer of the second embodiment, and printing an image at a higher precision than that of the inkjet printer of the second embodiment will be explained in detail.

A position shift of the ink landing position will be described.

As shown in the overall arrangement view of FIG. 11, the inkjet printer of the second embodiment can move the carriage and printing medium by the high-precision linear motors at a high precision. Even these high-precision linear motors suffer moving error factors such as pitching, yawing, and straightness. Thus, the landing position of ink applied to a printing medium shifts (printing dot position shifts) due to these error factors.

Figure 13:
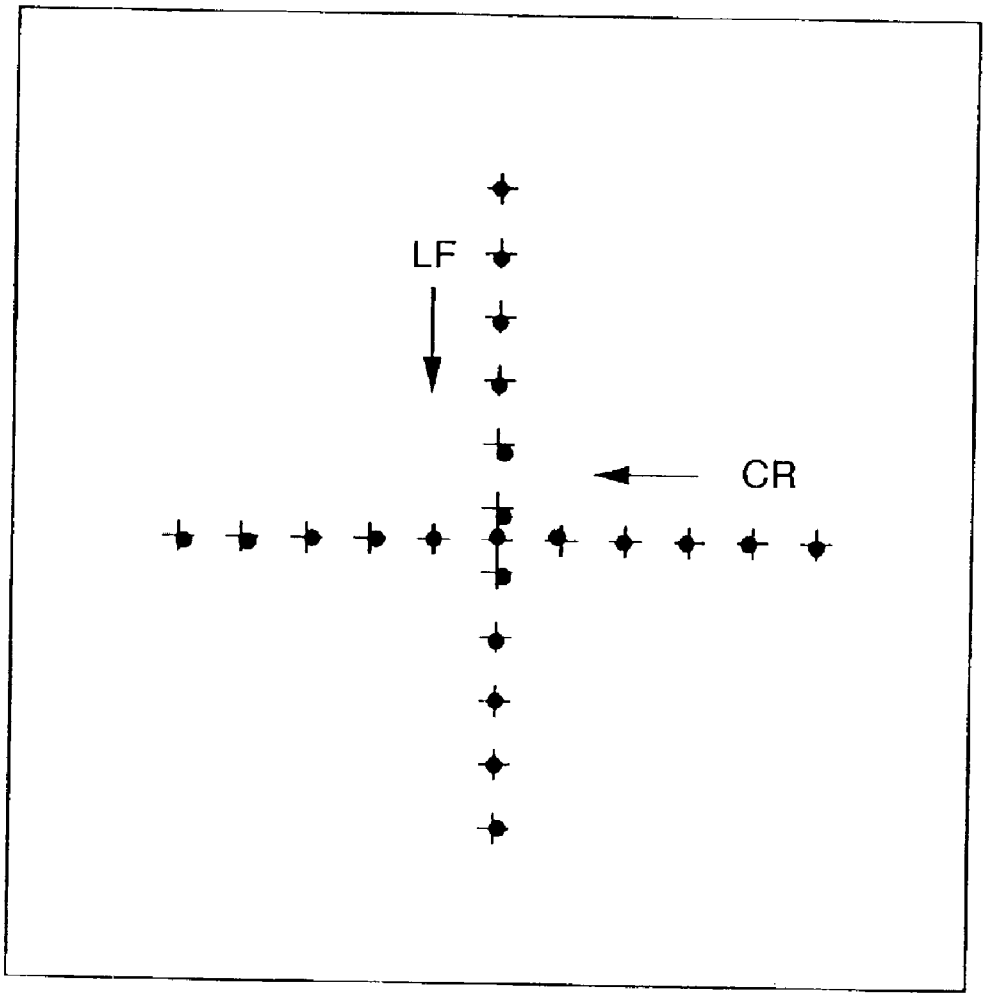
FIG. 13 is a measurement chart showing landing position shifts in the main scanning direction and subscanning direction in the inkjet printer according to the second embodiment of the present invention.

[Measurement of Landing Position Shift: FIG. 13]

FIG. 13 is a chart showing the position of a laser spot printed on a photosensitive film when a laser source is mounted vertically downward on the carriage 1102 instead of the printhead, the photosensitive film is set as a printing medium on the surface of the stage 1003, the CR linear motor 1001 or LF linear motor 1002 is moved to a predetermined position, and then the laser source emits a laser spot.

In the chart, a mark "+" represents an ideal position (position shift amount=0). Spot positions are plotted at 11 positions for each of the CR linear motor 1001 and LF linear motor 1002.

Figure 14:
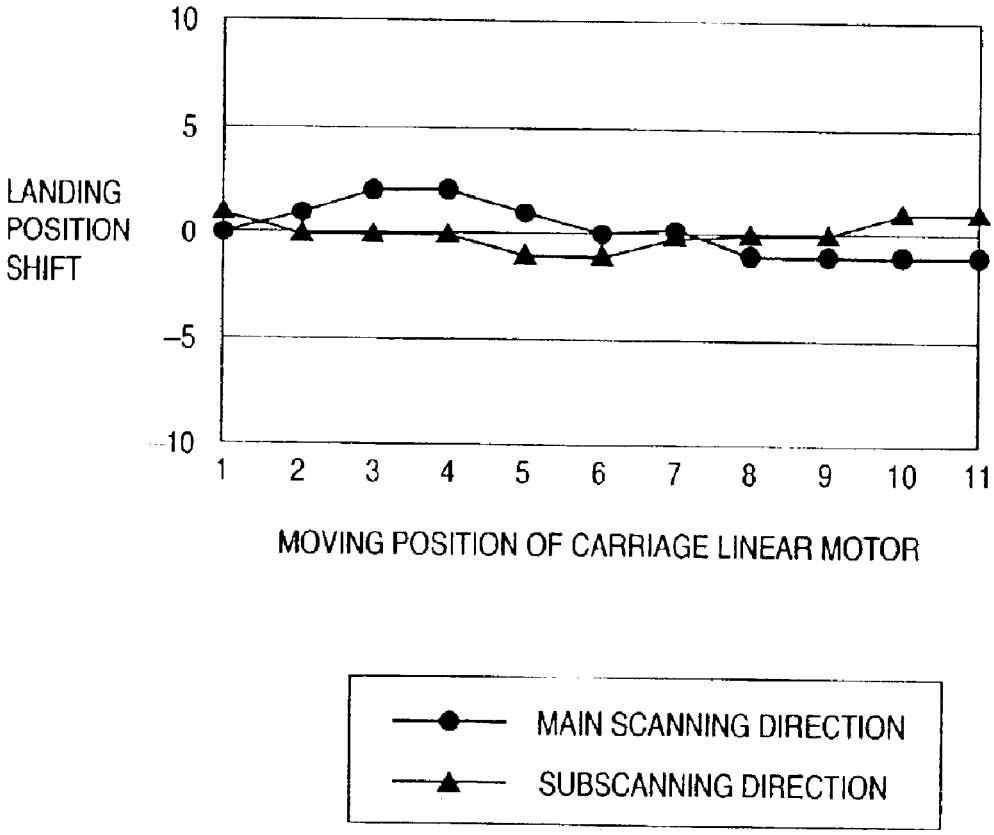
FIG. 14 is a graph showing the shift amount (landing position shift amount) of a spot in the main scanning direction and subscanning direction when a CR linear motor moves in the main scanning direction.
Figure 15:
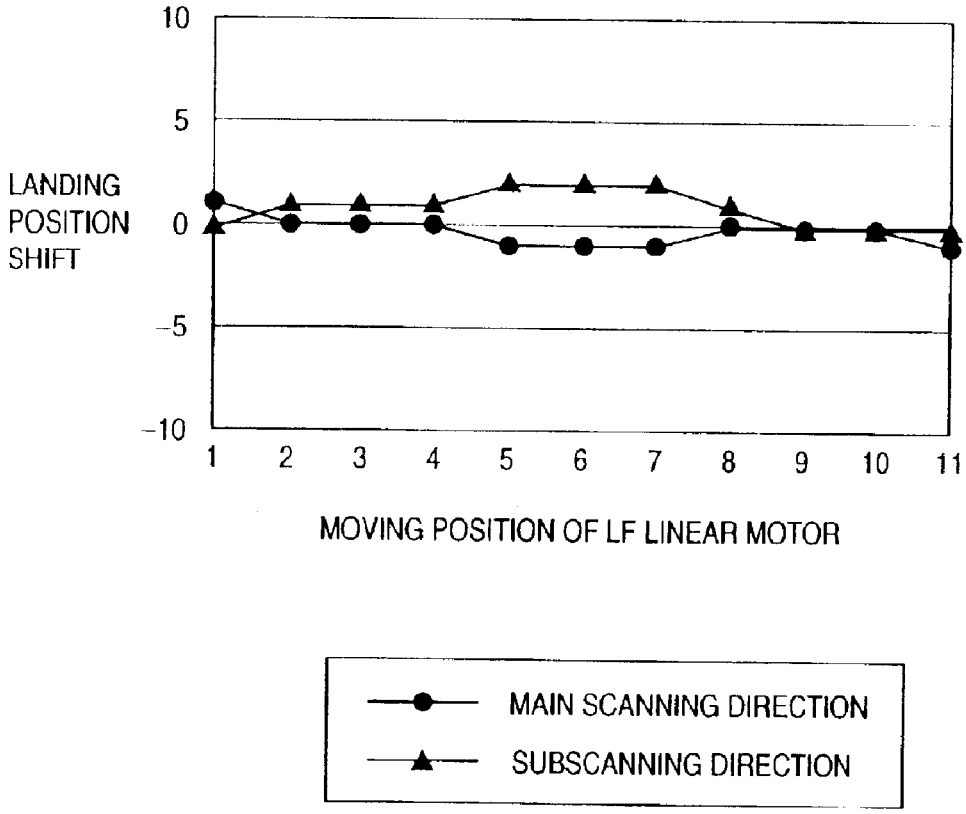
FIG. 15 is a graph showing the shift amount (landing position shift amount) of a spot in the main scanning direction and subscanning direction when an LF linear motor moves in the subscanning direction.

FIGS. 14 and 15 are graphs showing the shift amount of each spot from an ideal position that is obtained by measuring a spot position in FIG. 13 by an ultrahigh-precision position measurement device. FIG. 14 is a graph showing the shift amount of each spot from an ideal position in the main scanning direction and subscanning direction when the CR linear motor moves in the main scanning direction. FIG. 15 is a graph showing the shift amount of each spot from an ideal position in the main scanning direction and subscanning direction when the LF linear motor moves in the main scanning direction.

Since a laser beam emitted by the laser source is very stable, the shift amount of each spot from an ideal position results in the shift amount of a landing position that is caused by the moving error of the linear motor. The abscissa represents the moving positions of the CR linear motor 1001 and LF linear motor 1002, and the ordinate represents the shift amount of an ink landing position at each moving position. Landing position shift data are transmitted from the host computer to the main control unit 14 via the I/F unit 17, and stored as a table in the correction data memory 18. The main control unit 14 can refer to these data.

As for a position other than the above-mentioned measurement point, a landing position shift amount is obtained by linear interpolation by the main control unit 14, and the following landing position shift correction is executed on the basis of the obtained amount.

[Correction of Landing Position Shift in Main Scanning Direction by Carriage Moving Error]

A method of correcting a landing position shift in the main scanning direction caused by a carriage moving error on the basis of the above measurement data will be explained.

In FIG. 14, letting Mx(d) be the shift amount in the main scanning direction for a moving amount d from the home position of the carriage 1102, the shift amount at the nth image printing position from the image printing start position is Mx(Ls+n×Pr), and An is given by $$An=((Ls+n\times Pr)-Mx(Ls+n\times Pr))/Er \quad (6)$$

After all the contents of the RAM 300 are cleared to 0, An is calculated for all n image printing positions in accordance with equation (6). "1"s representing image printing are written at desired bits of data corresponding to the addresses An of the RAM 300. The landing position shift in the main scanning direction by the carriage moving error can be corrected to generate a printing position pulse at an original position.

[Correction of Landing Position Shift in Main Scanning Direction by Printing Medium Moving Error]

Similar to the conventional inkjet printer, the inkjet printer of the second embodiment is a serial printer, and alternately performs one scanning/printing and movement of a printing medium by one band to print an image. A landing position shift upon movement of the printing medium must also be corrected.

In FIG. 15, letting Sx(d) be the shift amount in the main scanning direction for a moving amount f from the home position of the printing medium 140, Ys be the printing start scanning position, and Yb be the scanning width in the subscanning direction, the shift amount of the nth scanning from printing start scanning is given by $$Sx(Ys+m\times Yb)$$

The scanning width Yb is the printing width (e.g., equal to the nozzle width of the printhead) of printing by one scanning in the moving direction. For descriptive convenience, the printing width is the same between scanning operations.

In this way, a shift amount corresponding to a printing medium convey position can be calculated and used to correct a main scanning shift.

For example, if the shift amount information is saved in the correction data memory 18, a position shift can be easily corrected.

In addition to correction of a landing position shift in the main scanning direction caused by a carriage moving error, letting A(m,n) be a RAM address corresponding to the printing position of the nth column in the mth scanning, A(m,n) is given by $$A(m,n)=((Ls+n\times Pr)-Mx(Ls+n\times Pr)-Sx(Ys+m\times Yb))/Er \quad (7)$$

After all the contents of the RAM 300 are cleared to 0 before the start of image printing by each scanning, A(m,n) is calculated for all image printing positions in accordance with equation (7). "1"s representing image printing are written at desired bits of data corresponding to the addresses A(m,n) of the RAM 300. The landing position shift in the main scanning direction by the moving errors of the carriage and printing medium can be corrected.

In this case, a long time is taken for write in the RAM 300. To catch up with the printing speed, for example, two RAMs 300 are arranged. In this arrangement, while read from one RAM 300 is executed, printing position data by the next scanning can be written in the other RAM. The above-described processing is executed by the main control unit 14 while referring to the contents of the correction data memory 18.

[Correction of Landing Position Shift in Subscanning Direction by Carriage Moving Error]

A method of correcting a landing position shift in the subscanning direction caused by a carriage moving error will be explained.

As shown in FIG. 14, the landing position also shifts in the subscanning direction while an image is printed by moving the carriage. The landing position shift can be corrected by slightly moving a printing medium in accordance with the landing position shift in the subscanning direction at the carriage position. In the inkjet printer of the second embodiment, the main control unit 14 comprises a dedicated controller which reads out carriage position information from the position detection unit 10, reads out landing position shift data at the position from the correction data memory 18, and controls the LF linear encoder. The landing position shift can be automatically corrected. The distance by which the printing medium is moved for correction is very small, and an error newly generated by this movement can be ignored. With this arrangement, the landing position shift in the subscanning direction can be corrected by slightly moving a printing medium even while the carriage is scanned.

[Correction of Landing Position Shift in Subscanning Direction by Printing Medium Moving Error]

A method of correcting a landing position shift in the subscanning direction caused by a printing medium moving error will be explained.

Even when the printing medium is moved by a desired amount in the subscanning direction, the landing position slightly shifts in the subscanning direction, as shown in FIG. 15. Hence, the printing medium is moved in consideration of this small shift amount in advance, realizing desired movement. That is, letting Sy(f) be the shift amount in the subscanning direction by the LF linear motor 1002 at a position f when the printing medium 140 is moved from the home position to the position f, a command value F to the LF linear motor 1002 is given by $$F=f-Sy(f)$$

When the LF linear motor 1002 is instructed of the moving position F, the printing medium 140 can be moved to the desired position f.

[Correction of Error Caused by Thermal Expansion of Encoder Scale]

The inkjet printer of the second embodiment must be installed at a place where the temperature is kept constant because a very high landing position precision is required. For a small temperature change, an error by thermal expansion of the encoder scale can be corrected by ignoring thermal expansion of the mechanical unit.

The temperature sensor 19 is arranged near the encoder scale 1131, and temperature data can be loaded into the main control unit 14. The main control unit 14 corrects printing position data on the basis of the temperature value, thereby correcting an error caused by thermal expansion of the encoder scale.

Letting T be the temperature value [° C.] represented by the temperature detection unit 19, To be the temperature [° C.] obtained by measuring calibration data of the encoder, i.e., the reference temperature, and k be the thermal expansion coefficient of the encoder scale 1131, An after thermal expansion error correction by equation (5) is given by $$An=((Ls+n\times Pr)\times(1+k\times(T-To)))/Er \quad (8)$$

Correction by equation (8) is added to correction by equation (7):

$$A(m,n)=(((Ls+n\times Pr)-Mx(Ls+n\times Pr)-Sx(Ys+m\times Yb))\times(1+k\times(T-To)))/Er \quad (9)$$

By the same method as that described in the absence of thermal expansion, An is calculated for all n image printing positions. "1"s representing image printing are written at desired bits of data corresponding to the addresses An of the RAM 300. As a result, an error by thermal expansion of the encoder scale 1131 is corrected, and an image is printed at a correct position.

In the second embodiment, the resolving power of the linear encoder 1130 is 0.5 μm, and the image printing position setting has an error of ±0.5 μm at maximum. The error of ±0.5 μm at maximum is merely ±5% (i.e., ±0.53 μm or less) of a 10.6-μm resolution pitch at 2,400 dpi. If the resolution will increase in the future, a linear encoder with a resolving power of, e.g., 0.1 μm can be used to make an error fall within the allowable range (e.g., about ±0.1 μm).

The second embodiment has exemplified a color inkjet printer having a plurality of printheads. The present invention is not limited to a color inkjet printer, and can also be applied to a commercially available inkjet printer, an image printing apparatus of another image printing type such as a thermal transfer image printing apparatus, and a general printer. The present invention is not particularly limited to the above embodiment.

[Image Printing Processing: FIG. 16]

FIG. 16 shows processing of printing in only the forward pass in the scanning direction (one-way printing) as an example of image printing processing by the above-described inkjet printer of the second embodiment. FIG. 16 shows processing of detecting the resolution of received printing data and performing image printing suitable for the resolution in creating an image from the received printing data. Also, FIG. 16 shows processing of correcting a read error at an image printing position upon changes in ambient temperature, and processing of correcting a position shift at each position of the printhead and each position of the printing medium, in order to print an image at a high precision. Image printing processing in FIG. 16 is merely an example. By applying processing in FIG. 16, the present invention can also be applied to printing in both the forward and return passes in the scanning direction (bi-directional printing).

Processing in FIG. 16 is executed by the main control unit 14 using the RAM as a work area on the basis of a control program stored in the ROM of the main control unit 14 while controlling each unit. An example of this processing will be explained in detail.

In step S1501, if printing data is received, the printing data is stored in the memory, and the resolution of an image to be printed is detected from the printing data.

In step S1502, the nth image printing position An from the image printing start position is generated as image printing position data corresponding to the detected resolution so as to perform image printing suitable for the detected resolution.

In step S1503, whether correction at each position is performed for the image printing position data is determined. If correction is performed (YES in step S1503), the flow advances to step S1504 to perform position correction, and then to step S1505. If no position correction is performed (NO in step S1503), the flow advances to step S1505 without any processing.

If correction depending on the ambient temperature is performed for the printing position data (YES in step S1505), the flow advances to step S1506 to perform correction depending on the ambient temperature, and then to step S1507. If no correction depending on the ambient temperature is performed (NO in step S1505), the flow directly advances to step S1507.

In step S1507, "1"s are written at RAM addresses An separately for the forward and return passes in the printhead scanning direction ("1" represents a printing position, and "0" represents no printing position).

If driving of the carriage starts in step S1508, the printing position is detected in step S1509 to output a count value. In step S1510, a RAM address corresponding to the count value is accessed, and if the address represents an image printing position, a printing position pulse is generated to print an image. Thereafter, the flow advances to step S1511.

If image printing of one band has not ended in step S1511, the flow returns to step S1509 to repeat the above-described processing. If image printing of one band ends, the flow advances to step S1512 to return the carriage to the home position and end a series of processes.

As described above, the inkjet printer of the second embodiment can use a high-resolving-power linear encoder to detect a printhead position at a precision several ten times that of a conventional inkjet printer. In printing an image from received printing data, image printing position data suitable for the resolution of the received printing data can be generated to print an image. One inkjet printer can print an image at the resolutions of both the 300- and 360-dpi systems. An image can also be printed at another resolution if the memory capacity and memory access permit. As printing position information, "1" represents a printing position, and "0" represents a non-printing position. However, another data may be adopted. Image printing may be controlled using "0" as a printing position and "1" as a non-printing position.

In the inkjet printer of the second embodiment, position pulse signals from the linear encoder arranged along the printhead moving direction are counted to detect the main scanning position of the printhead. In writing image printing position information in the main scanning direction in the memory by using the position data as an address, the image printing position information is corrected and written in accordance with a landing position shift amount at the main scanning position that is measured in advance. Any landing position error of the carriage moving means of the inkjet printer can be minimized.

In writing image printing position information every scanning, the landing position shift amount in the main scanning direction that is caused by the LF linear motor in scanning is corrected. A landing position shift in the main scanning direction by the LF linear motor of the inkjet printer can be suppressed.

As for a landing position shift in the subscanning direction, the landing position shift amount in the subscanning direction by the carriage moving means can be corrected by sequentially moving the LF linear motor.

As for a moving error of the LF linear motor in the subscanning direction, the printing medium can be accurately fed by moving the LF linear motor in consideration of the subscanning moving error in advance.

Image printing position information can be set independently in the forward and return passes, and misregistration in the forward and return passes can be corrected.

Misregistration between a plurality of heads can be corrected by setting image printing position information independently for each printhead.

Also, an image can be printed at an arbitrary resolution by rewriting image printing position information at the image printing resolution in the main scanning direction.

Any landing position shift by thermal expansion of the linear encoder can be corrected by correcting and writing image printing position information in accordance with the ambient temperature.

[Other Embodiment]

The inkjet printer according to the above embodiments can increase the density and resolution of printing by using a system which comprises a means (e.g., an electrothermal transducer or laser beam) for generating heat energy as energy used to discharge ink and causes a state change of ink by this heat energy, among other inkjet printing systems.

As the typical arrangement and principle, it is preferable to use the basic principle disclosed in, e.g., U.S. Pat. Nos. 4,723,129 and 4,740,796. This system is applicable to both a so-called on-demand apparatus and a so-called continuous apparatus. The system is particularly effective in an on-demand apparatus because at least one driving signal which corresponds to printing information and gives a rapid temperature rise exceeding nucleate boiling is applied to an electrothermal transducer which is arranged in correspondence with a sheet or channel holding a liquid (ink), heat energy is generated by the electrothermal transducer to effect film boiling on the heat acting surface of the printhead, and consequently a bubble can be formed in the liquid (ink) in one-to-one correspondence with the driving signal.

The liquid (ink) is discharged from an orifice by growth and shrinkage of this bubble, forming at least one droplet. This driving signal is more preferably a pulse signal because growth and shrinkage of a bubble are instantaneously and appropriately performed to discharge the liquid (ink) with a good response characteristic.

A full line type printhead having a length corresponding to the width of the largest printing medium printable by a printing apparatus can take a structure which attains this length by combining a plurality of printheads as disclosed in the above-mentioned specification, or can be a single integrated printhead.

In addition, it is possible to use not only a cartridge type printhead explained in the above embodiments in which an ink tank is integrated with a printhead itself, but also an interchangeable chip type printhead which can be electrically connected to an apparatus main body and supplied with ink from the apparatus main body when attached to the apparatus main body.

It is preferable to add a printhead recovery means or preliminary means to the printing apparatus because printing operation can further be stabilized. Practical examples of the additional means are a capping means for the printhead, a cleaning means, a pressurizing or suction means, an electrothermal transducer, another heating element, and a preliminary heating means as a combination of the electrothermal transducer and heating element. A predischarge mode in which discharge is performed independently of printing is also effective for stable printing.

The printing mode of the printing apparatus is not limited to a printing mode using only a main color such as black. That is, the apparatus can adopt at least a composite color mode using different colors and a full color mode using color mixture, regardless of whether the printhead is an integrated head or a combination of a plurality of heads.

The above embodiments assume that ink is a liquid. It is also possible to use ink which solidifies at room temperature or less and softens or liquefies at room temperature. A general inkjet system performs temperature control such that the viscosity of ink falls within a stable discharge range by adjusting the ink temperature within the range of 30° C. (inclusive) to 70° C. (inclusive). Hence, ink need only be a liquid when a printing signal used is applied to it.

In order to prevent a temperature rise caused by heat energy by positively using the temperature rise as energy of the state change from the solid state to the liquid state of ink, or to prevent evaporation of ink, ink which solidifies when left to stand and liquefies when heated can be used. In any case, the present invention is applicable to any ink which liquefies only when heat energy is applied, such as ink which liquefies when applied with heat energy corresponding to a printing signal and is discharged as liquid ink, or ink which already starts to solidify when arriving at a printing medium.

The object of the present invention is also achieved when a storage medium which stores software program codes for realizing the functions of the above-described embodiments is supplied to a system or apparatus, and the computer (or the CPU or MPU) of the system or apparatus reads out and executes the program codes stored in the storage medium. In this case, the program codes read out from the storage medium realize the functions of the above-described embodiments, and the storage medium which stores the program codes constitutes the present invention.

The storage medium for supplying the program codes includes a floppy disk, hard disk, optical disk, magnetooptical disk, CD-ROM, CD-R, magnetic tape, nonvolatile memory card, and ROM.

The functions of the above-described embodiments are realized when the computer executes the readout program codes. Also, the functions of the above-described embodiments are realized when an OS (Operating System) or the like running on the computer performs part or all of actual processing on the basis of the instructions of the program codes.

The functions of the above-described embodiments are also realized when the program codes read out from the storage medium are written in the memory of a function expansion board inserted into the computer or the memory of a function expansion unit connected to the computer, and the CPU of the function expansion board or function expansion unit performs part or all of actual processing on the basis of the instructions of the program codes.

When the present invention is applied to the storage medium, the storage medium stores programs which realize the above-mentioned processes shown in FIGS. 10 and 16.

As described above, in the inkjet printer of the embodiments, position pulse signals from the linear encoder arranged along the printhead moving direction are counted to detect the main scanning position of the printhead. The position data is used as the address of the memory in which image printing position information in the main scanning direction is written in advance. Image printing operation is performed in accordance with the image printing position information written in advance. An image can be printed under arbitrary image printing conditions.

Image printing position information can be set independently in the forward and return passes in accordance with the image printing direction in the main scanning direction. Misregistration in the forward and return passes can, therefore, be corrected.

Misregistration between a plurality of heads can be corrected by setting image printing position information independently for each printhead.

Also, an image can be printed at an arbitrary resolution by rewriting image printing position information at the image printing resolution in the main scanning direction.

A landing position shift by thermal expansion of the linear encoder can be corrected by correcting and writing image printing position information in accordance with the ambient temperature.

A landing position shift by the manufacturing error of the linear encoder can also be corrected by correcting and writing image printing position information on the basis of calibration data of the linear encoder.

An image can be printed while minimizing a landing position shift caused by mechanical error factors such as pitching and yawing of the carriage moving means and printing medium moving means.

As has been described above, the present invention can provide an image printing apparatus capable of printing an image at various resolutions such as the 300-dpi system and 360-dpi system, and a control method therefor.

As many apparently widely different embodiments of the present invention can be made without departing from the spirit and scope thereof, it is to be understood that the invention is not limited to the specific embodiments thereof except as defined in the claims.

What is claimed is:

1. An image printing apparatus which moves a carriage having a printhead in a main scanning direction different from a subscanning direction in which a printing medium is conveyed, and prints on the basis of input printing data, comprising:

printing position information generation means for generating printing position information, which represents a position to be printed in the main scanning direction of the printing medium, corresponding to a resolution of the printing data;

storage means for storing a plurality of printing position data using the generated printing position information as an address;

position detection means for detecting a position of the printhead which moves in the main scanning direction, and generating printhead position information indicating the position of the printhead; and printing position signal generation means for outputting a printing position signal for driving the printhead on the basis of the printing position data read out of said storage means using the generated printhead position information as an address.

2. The apparatus according to claim 1, further comprising transfer means, having a buffer memory for storing the printing data and a printhead driving unit, for transferring the printing data from the buffer memory to the printhead driving unit in synchronism with the printing position signal.

3. The apparatus according to claim 1, wherein said printing position information generation means generates pieces of printing position information so as to set different positions to which the printhead is driven between forward and return passes of the printhead in the scanning direction, and stores the pieces of generated information in different storage areas of said storage means.

4. The apparatus according to claim 1, further comprising temperature detection means for detecting an ambient temperature of said position detection means, wherein said printing position information generation means comprises correction means for correcting the printing position information in accordance with the detected ambient temperature.

5. The apparatus according to claim 1, further comprising second storage means for storing positional shift information of a printing dot on the printing medium in the main scanning direction, wherein said printing position information generation means comprises correction means for correcting the printing position information on the basis of the positional shift information.

6. The apparatus according to claim 5, wherein the positional shift information of the printing dot in the main scanning direction includes information on a positional shift generated when the printhead moves in the main scanning direction.

7. The apparatus according to claim 5, wherein the positional shift information of the printing dot in the main scanning direction includes information on a positional shift generated when the printing medium is moved in the subscanning direction.

8. The apparatus according to claim 1, further comprising a plurality of printheads, wherein pieces of printing position information are stored in said storage means in correspondence with the printheads.

9. The apparatus according to claim 1, further comprising convey means for conveying the printing medium and convey control means, wherein said convey control means controls a convey amount of said convey means on the basis of positional shift information in the subscanning direction that corresponds to a position of the printhead obtained by said position detection means.

10. The apparatus according to claim 1, further comprising convey means for conveying the printing medium, convey control means, and second position detection means for detecting a position of the printing medium moved in a convey direction, wherein said convey control means controls a convey amount of said convey means on the basis of positional shift information in the subscanning direction that corresponds to the position of the printing medium obtained by said second position detection means.

11. The apparatus according to claim 1, wherein said storage means stores first data or second data in positions indicated by a series of addresses in the main scanning direction, wherein the second data are stored in positions indicated by a plurality of addresses between an address indicating a first data stored position and a next address indicating a first data stored position.

12. The apparatus according to claim 1, wherein said storage means stores first data or second data in positions indicated by a series of addresses in the main scanning direction, wherein an address interval between an address indicating a first data stored position and a next address indicating a first data stored position is determined by a resolution of the input printing data and a resolution of said position detection means.

13. The apparatus according to claim 1, wherein a resolution of said position detection means is higher than the resolution of input printing data.

14. A method of controlling an image printing apparatus which moves a carriage having a printhead in a main scanning direction different from a subscanning direction in which a printing medium is conveyed, and prints on the basis of input printing data, comprising:

a printing position information generation step of generating printing position information, which represents a position to be printed in the main scanning direction of the printing medium, corresponding to a resolution of the printing data;

a storage step of storing, in storage means, a plurality of printing position data using the generated printing position information as an address;

a position detection step of detecting a position of the printhead which moves in the main scanning direction, and generating printhead position information indicating the position of the printhead; and a printing position signal generation step of outputting a printing position signal for driving the printhead on the basis of the printing position data read out of the storage means using the generated printhead position information as an address.

15. An image printing apparatus which moves a carriage having a printhead in a main scanning direction different from a subscanning direction in which a printing medium is conveyed, and prints on the basis of input printing data, comprising:

driving means for driving the printhead;

position detection means for detecting a position of the printhead, which moves in the main scanning direction, with predetermined resolution and generating printhead position information indicating the position of the printhead;

resolution detecting means for detecting a resolution of the input printing data;

printing position information generation means for generating printing position information, which represents a position to be printed in the main scanning direction of the printing medium, corresponding to the detected resolution;

storage means for storing printing position data using the generated printing position information as an address;

reading means for reading printing position data out of said storage means in an order indicated by a series of addresses in the main scanning direction; and printing position signal generation means for outputting a printing position signal to said driving means on the basis of the printing position data.

16. The apparatus according to claim 15, wherein if read printing position data is first data, said printing position signal generation means outputs a printing position signal to said driving means, and if read printing position data is second data, said printing position signal generation means does not output the printing position signal to said driving means.

17. The apparatus according to claim 15, wherein the predetermined resolution of said position detection means is higher than the resolution of input printing data.

18. An image printing apparatus which moves a carriage having a printhead in a main scanning direction different from a subscanning direction in which a printing medium is conveyed, and prints on the basis of input printing data, comprising:

address generation means for generating a writing address corresponding to a printing position, which represents a position to be printed in the main scanning direction of the printing medium, on the basis of a resolution of the input printing data;

storage means for storing printing position data in the generated writing address;

printhead position information generating means for generating printhead position information on the basis of an encoder signal output by an encoder; and printing position signal generation means for outputting a printing position signal for driving the printhead on the basis of the printing position data read out of said storage means using the generated printhead position information as a reading address.

* * * * *